US009580290B1

(12) United States Patent
Gallagher

(10) Patent No.: US 9,580,290 B1
(45) Date of Patent: Feb. 28, 2017

(54) COUNTER WATER BOTTLE DISPENSER

(71) Applicant: Kenneth John Gallagher, Las Vegas, NV (US)

(72) Inventor: Kenneth John Gallagher, Las Vegas, NV (US)

( * ) Notice: Subject to any disclaimer, the term of this patent is extended or adjusted under 35 U.S.C. 154(b) by 0 days.

(21) Appl. No.: 15/155,038

(22) Filed: May 15, 2016

Related U.S. Application Data

(63) Continuation-in-part of application No. 15/017,613, filed on Feb. 6, 2016.

(51) Int. Cl.
*B67D 7/06* (2010.01)
*B67D 3/00* (2006.01)

(52) U.S. Cl.
CPC ..... *B67D 3/0032* (2013.01); *B67D 3/008* (2013.01); *B67D 3/0061* (2013.01)

(58) Field of Classification Search
CPC .. B67D 3/0035; B67D 3/0061; B67D 3/0029; B67D 3/0032; B67D 3/0054; B67D 3/008
USPC ..... 222/80, 184, 185.1
See application file for complete search history.

(56) References Cited

U.S. PATENT DOCUMENTS 948,883 A * 2/1910 Hughes ..... B65D 81/3222 137/364
1,995,703 A * 3/1935 Clark ..... B65D 1/0207 118/DIG. 3
2,056,863 A * 10/1936 Napier ..... B67D 3/0029 222/185.1
2,138,060 A * 11/1938 Conner ..... B65D 47/246 220/661
2,663,076 A * 12/1953 Robinson ..... B67B 7/24 30/446
3,104,089 A 9/1963 Seltsam
3,207,472 A 9/1965 Seltsam
3,301,525 A 1/1967 Chemak
3,848,776 A * 11/1974 Schieser ..... B65D 85/54 222/105
4,293,082 A 10/1981 Matsueda
5,121,778 A * 6/1992 Baker ..... B67D 3/0032 141/18
5,123,720 A 6/1992 Blomster
5,509,583 A * 4/1996 Dolson ..... B67D 3/046 222/185.1
5,647,416 A 7/1997 Desrosiers
6,241,126 B1 6/2001 Goodman
6,527,145 B1 3/2003 Bennett, Jr.
6,557,735 B1 * 5/2003 Stray ..... B67D 3/0029 222/185.1
6,892,903 B1 5/2005 Barolotta
2002/0069664 A1 * 6/2002 Davis ..... B67D 3/0009 62/392
2010/0314416 A1 * 12/2010 Wezner ..... A47G 23/0208 222/185.1

(Continued)

*Primary Examiner* — Patrick M Buechner

(57) ABSTRACT

A walled dispenser base for use with a removable bottle collar for delivering a liquid from a supply bottle has a hollow interior. A rim is formed at a top portion of the walled dispenser base. A foot is formed at a bottom portion of the walled dispenser base. A side opening is formed in a sidewall of the walled dispenser base. The side opening enables a valve coupled to a mouth of the supply bottle inverted and positioned within the removable collar to pass from an interior of the walled dispenser base to a location outside the walled dispenser base.

10 Claims, 40 Drawing Sheets

(56) References Cited

U.S. PATENT DOCUMENTS

| | | | | |
|---|---|---|---|---|
| 2011/0006078 | A1* | 1/2011 | Hsu | B67D 3/0009 222/129 |
| 2013/0341355 | A1* | 12/2013 | Weaver | B67D 3/0035 222/108 |
| 2015/0259188 | A1* | 9/2015 | Smith | B67D 3/0061 222/478 |
| 2016/0244312 | A1* | 8/2016 | Gallagher | B67D 3/0061 |
| 2016/0244313 | A1* | 8/2016 | Gallagher | B67D 3/0096 |

* cited by examiner

COUNTER WATER BOTTLE DISPENSER

CROSS REFERENCE TO RELATED APPLICATIONS

This is a continuation-in-part of application Ser. No. 15/017,613 filed on 2016 Feb. 6, entitled "COUNTER WATER BOTTLE DISPENSER" in the name of Kenneth J. Gallagher, and which is incorporated herein by reference in its entirety.

BACKGROUND OF THE DISCLOSURE

The present application generally relates to a bottled water dispenser, and, more particularly, to water bottle holders and water bottle dispensers that provide a convenient and simplified mechanism to access bottled water in a direct manner.

With the advent of increased popularity of bottled spring water and bottled purified water here and abroad, a need may have developed for water bottle holders and water bottle dispensers that may provide a convenient and simplified mechanism to access bottled water. In the past, water may have been dispensed through a water crock or similar devices. Water crocks may be jars or containers that store water. A dispensing device may be located at the bottom of the water crock for releasing water stored within the container. Water crocks generally require filling prior to usage and generally need to be cleaned periodically. Water dispensers have evolved from the simple water crocks to bottled water dispensers ranging from the original multiple gallon glass jugs that were inverted and positioned within large free standing and often refrigerated water coolers to the more current, disposable plastic bottles and single use "gallon" plastic water jugs.

A limited number of companies of companies offer purified and spring water in countertop plastic water jug dispensers. These plastic water jug dispensers may typically require that the dispensers lay flat on the countertop, and a single use valve may be located at the bottom of the jug. Of the few brands that do offer a countertop dispenser version of their product, several problems may be associated with their dispensers. To begin with, the user generally needs to administer a vent hole in these dispensers. Unfortunately, these plastic water jug dispensers generally do not provide a piercing tool for this task. Furthermore, the single use valves that are offered with the small number of branded countertop dispensers that are on the market may be of a low quality and may often leak. Lastly, these dispensers may present a number of practical placement and use restrictions and problems.

Over the years, a variety of U.S. patents have issued on dispensing valves/valve parts, and water dispensing devices. U.S. Pat. No. 4,293,082 issued to Shinji Matsueda shows one way in which an inverted bottle can be supported by a stand that includes a thermal insulator for the inverted bottle. U.S. Pat. No. 5,123,720 issued to Blomster et al. discloses a floor based inverted water bottle stand for a 5 gallons bottle. As with the Shinji patent, the Bolomster et al. is patenting the stand that supports an inverted bottle. U.S. Pat. No. 5,647,416 issued to Desrosiers et al. discloses another patent on a stand for a 5 gallons bottle that includes a reservoir and the support housing for the reservoir.

U.S. Pat. No. 6,241,126 issued to Andrew Goodman discloses a personal beverage desktop dispenser with a cubical base and valve housed therein. The male bottle threads are mated with the female threads of the base. An issue with this embodiment is that it may be difficult to invert the entire dispenser to union it with the upright bottle since the bottle valve is secured to the base. Even if the valve was not secured to the base, the valve with the handle is too large to fit through the bottle hole in the base top. It could prove rather difficult to threadably secure an entire base onto a bottle. Moreover, the base could become unsanitary rather quickly having liquid spilled within the base and it appears to be rather difficult to clean.

U.S. Pat. No. 6,527,145 issued to Jules G. Bennett, Jr. discloses a personal desktop beverage dispenser that has a base holding an inverted bottle with the bottle male threads threadably secured to the female threads of the dispenser base. An outflow valve controls the flow of bottle contents to a cup placed beneath. While this embodiment can be used with more than one bottle size it requires having to invert the entire base and threadably secure it onto an upright bottle, which could prove to be rather difficult.

U.S. Pat. No. 6,892,903 issued to Salvatore Barolotta discloses a personal beverage bottle dispenser. The personal beverage bottle dispenser requires that the entire base be inverted and threadably secured to the upright bottle in order to union the bottle with the valve.

U.S. Pat. No. 3,104,089 issued to Harold O. Seltsam, shows a self-closing lift type faucet adapted for use with water crocks, certain coolers, and beverage dispensers. Similarly, U.S. Pat. No. 3,207,472 issued Sep. 25, 1965 to Seltsam shows a tubular diaphragm valve. As with the self-closing valve, this valve is again configured for use with water crocks, certain coolers, and beverage dispensers.

SUMMARY OF THE DISCLOSURE

In accordance with one embodiment a walled dispenser base for use with a removable bottle collar for delivering a liquid from a supply bottle is disclosed. The walled dispenser base has a hollow interior. A rim is formed at a top portion of the walled dispenser base. A foot is formed at a bottom portion of the walled dispenser base. A side opening is formed in a sidewall of the walled dispenser base. The side opening enables a valve coupled to a mouth of the supply bottle inverted and positioned within the removable bottle collar to pass from the interior of the walled dispenser base to a location outside of the walled dispenser base.

In accordance with one embodiment a walled dispenser base for use with a removable bottle collar for delivering a liquid from a supply bottle is disclosed. The walled dispenser base has a hollow interior. A rim is formed at a top portion of the walled dispenser base. The rim has an open section. A foot is formed at a bottom portion of the walled dispenser base. A side opening is formed in a sidewall of the walled dispenser base. The side opening extends upward through the open section of the rim. A valve coupled to the supply bottle can be lowered directly downward into the walled dispenser base through the side opening of the walled dispenser base.

In accordance with one embodiment a walled dispenser base for delivering a liquid from a supply bottle is disclosed. The walled dispenser base has a hollow interior. A rim is formed at a top portion of the walled dispenser base. The rim has an open section. A foot is formed at a bottom portion of the walled dispenser base. A side opening is formed in a sidewall of the walled dispenser base. The side opening extends upward through the open section of the rim. A removable bottle collar engages with the walled dispenser base. The removable bottle collar is adapted to engage a support the supply bottle inverted and positioned within the removable bottle collar. The removable bottle collar has a side gap. The side gap in the side of the removable bottle collar aligns with the open section of the rim to form a valve passage. The valve passage enables a valve coupled to a mouth of the supply bottle to be lowered directly downward into the walled dispenser base. The removable bottle collar has a center aperture where the mouth of the supply bottle extends there through. The liquid from the supply bottle is delivered from the mouth of the supply bottle through the side opening to a location outside of the walled dispenser base.

In accordance with one embodiment a dispenser base for delivering a liquid from a supply bottle is disclosed. The dispenser base has a hollow interior. A rim is formed at a top portion of the dispenser base. The rim has an open section. A foot is formed at a bottom portion of the dispenser base. A side opening is formed in a sidewall of the dispenser base. The side opening extends upward through the open section of the rim. A removable bottle collar engages with the dispenser base. The removable bottle collar is adapted to engage a support the supply bottle inverted and positioned within the removable bottle collar. The removable bottle collar has a side gap. The side gap of the removable bottle collar aligns with the open section of the rim to form a valve passage. The valve passage enables a valve coupled to the mouth of the supply bottle to be lowered directly downward into the dispenser base. The removable bottle collar has a center aperture where the mouth of the supply bottle extends there through. The liquid from the supply bottle is delivered from the mouth of the supply bottle through the side opening to a location outside of the dispenser base.

BRIEF DESCRIPTION OF THE DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein.

DETAILED DESCRIPTION OF THE DISCLOSURE

Figure 1:
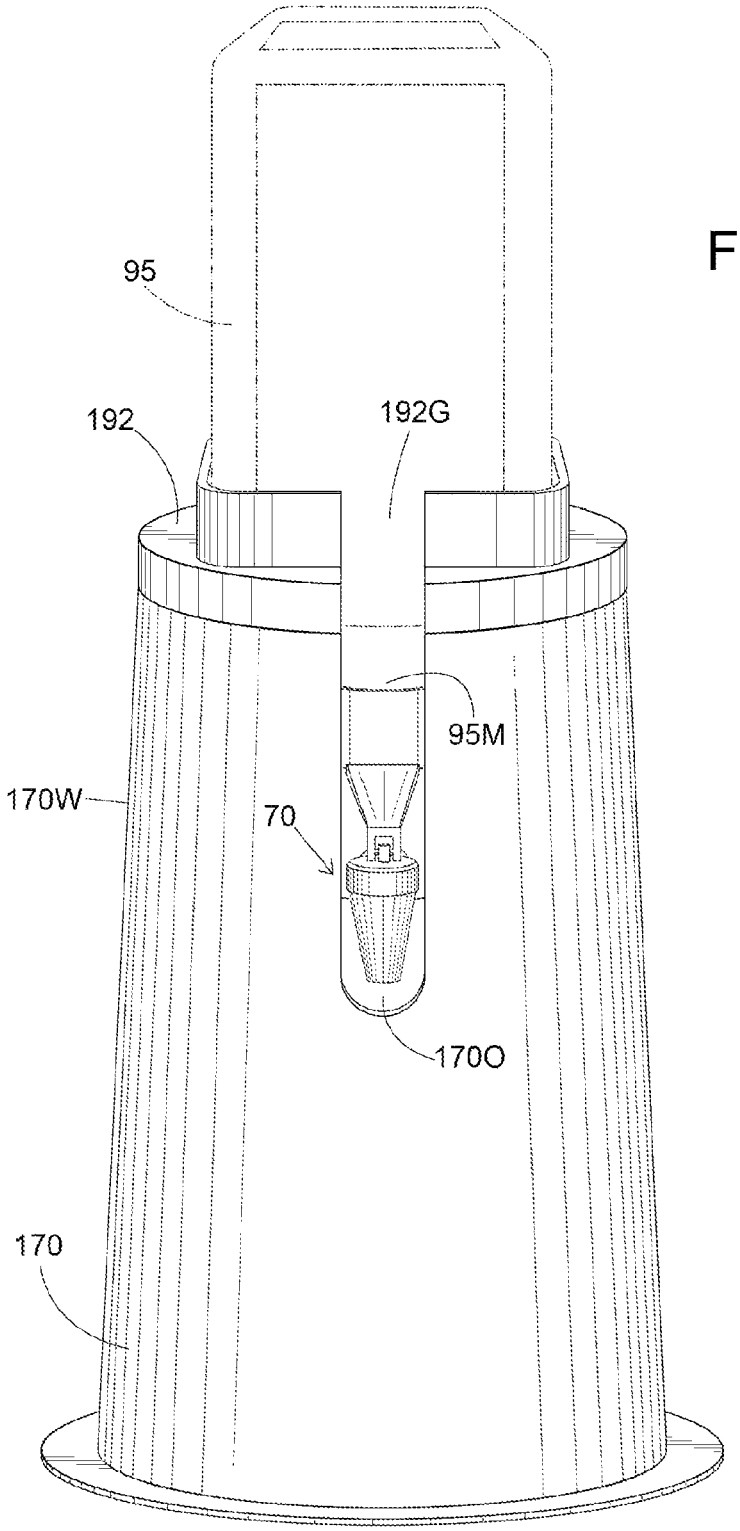
FIG. 1 is a perspective side view of an exemplary water bottle dispenser in accordance with one aspect of the present application.

The description set forth below in connection with the appended drawings is intended as a description of presently preferred embodiments of the disclosure and is not intended to represent the forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that also are intended to be encompassed within the spirit and scope of this disclosure.

Accordingly, there are one or more aspects to the present water bottle dispenser that offers advantages over the current existing methods that are being used to serve people water. Embodiments of the disclosure provide a water bottle dispenser that may allow water to be accessed directly from single use water bottles for use with the water bottle dispenser, with no transfer of water to a container required.

In accordance with one embodiment the dispenser base may facilitate a placement of a valve coupled to a water supply bottle into the dispenser base. The dispenser base may have a side opening formed in a sidewall of the dispenser base that may extend upward through an open section of a rim of the dispenser base. The side opening in the dispenser base may make it possible to lower the valve coupled to the water supply bottle directly downward into the dispenser base and may simplify the process of placing the valve coupled to the water supply bottle into the dispenser base. In accordance with one embodiment the dispenser may facilitate a placement of a valve coupled to a water supply bottle into the dispenser base. The dispenser base may have a side opening formed in a sidewall of the dispenser base that may extend upward through an open section of a rim of the dispenser base. A removable bottle collar of the dispenser base may have a side gap that may be aligned with the open section of the rim of the dispenser base to form a valve passage. The valve passage in the dispenser base may make it possible to lower the valve coupled to the water supply bottle directly downward into the dispenser base and may simplify the process of placing the valve coupled to the water supply bottle into the dispenser base.

In accordance with one embodiment, the water bottle dispenser may reduce the problem of not having a tool to administer a vent hole in the inverted supply bottle. The bottle dispenser may provide a piercing tool located in a threaded cylinder attached to the bottle dispenser. The piercing tool may quickly be accessed to administer a vent hole the supply bottle. Once a vent hole is administered in the supply bottle, the piercing tool may be placed back in the threaded cylinder where it stored, so that it is available for use to vent the next supply bottle that may be used with the water bottle dispenser. A bottle cap of the supply bottle may be threadably secured to the threaded cylinder. Thus the threaded cylinder may serve as a retainer for the bottle cap of the supply bottle that is used with the water bottle dispenser, which may prevent the bottle cap from being lost.

In accordance with one embodiment, the dispenser may provide a removable dispenser valve. The dispenser valve may be threadably secured to an upright supply bottle. The installation of the dispenser valve onto the upright supply bottle may be easy as only the valve is required to be coupled to the supply bottle. The dispenser valve may control the flow of water for the supply bottle. In accordance with one embodiment, the dispenser valve may have a reservoir in a valve body of the dispenser valve, that may store a predetermined quantity of water transferred from the supply bottle to coupled to the dispenser valve. The transfer of water may drop the water level in the supply bottle to a predetermined level. The dropped water level may allow for a vent hole to be administered in the supply bottle without water escaping out of the vent hole. In accordance with one embodiment, the dispenser valve may be a vented dispenser valve, and may have a vent tube in a valve body of the dispenser valve, and the tube may begin at a vent tube inlet port in the valve body. The vent tube of the dispenser valve may have a barbed vent tube port that may couple to a tube, and the tube may couple to a check valve. The vented dispenser valve generally does not require a vent hole to be formed in the supply bottle, and may allow for the inverted supply bottle to be turned up upright and placed in a refrigerator if needed.

Lastly, the dispenser valve may be an improvement over the "one-off" dispenser valves that are commonly used with countertop dispensers, so the quality and life of the dispenser valve may be better, and the dispenser valve may be less likely to leak. The above advantages of one or more aspects of the water bottle dispenser will become apparent upon reflection of the disclosure set forth below.

Referring to FIG. 1 a perspective side view of a water bottle dispenser (hereinafter dispenser) is shown. The dispenser may have a walled dispenser base 170 (hereinafter base 170). In the present embodiment, the base 170 may be cylindrical in shape. However, only one example is illustrated, and the base 170 may be formed in a number of other geometrical shapes and sizes. As shown in FIG. 1, the base 170 may be tapered. Thus, a bottom portion of the base 170 may be wider than an upper portion of the base 170. The tapered nature of the base 170 may provide added stability, and may allow for the base 170 to be stacked. The base 170 may be formed to have a hollow interior. The base 170 may have a removable bottle collar 192 (hereinafter bottle collar 192). The bottle collar 192 may have a side gap 192G. The base 170 and the bottle collar 192 may be constructed of a durable plastic such as polypropylene or of a metal such as stainless steel. The bottle collar 192 may be removably engaged upon the base 170. The base 170 may be used to support the bottle collar 192. The bottle collar 192 may be used to engage a supply bottle 95 inverted and positioned within the bottle collar 192. A dispenser valve 70 may be used to dispense water (hereinafter liquid) from the supply bottle 95. A side opening 170O may be formed in a sidewall 170W the base 170 may enable the dispenser valve 70 to coupled to a mouth 95M of the supply bottle 95 inverted and positioned within the bottle collar 192 to pass from an interior of the base 170 to a location outside the base 170.

Figure 2:
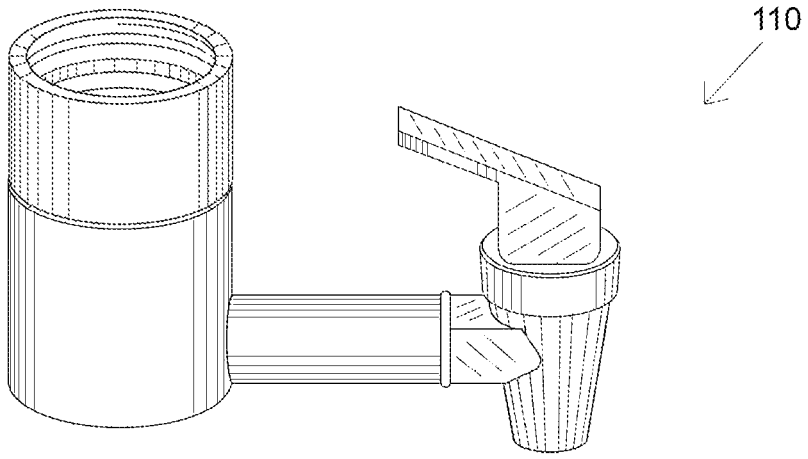
FIG. 2 is a perspective side view of an exemplary reservoir dispenser valve used with the exemplary water bottle dispenser in accordance with one aspect of the present application.
Figure 3:
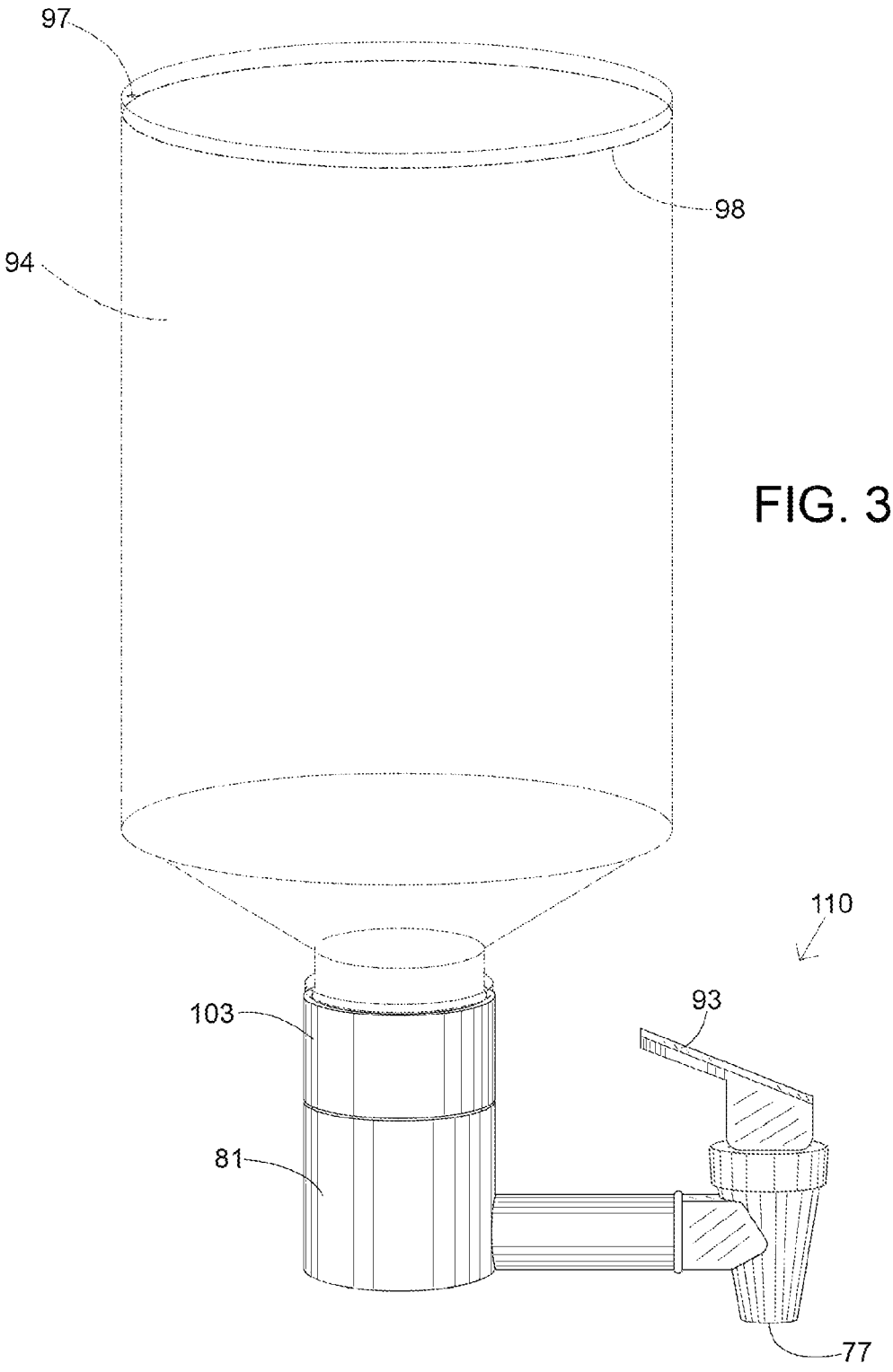
FIG. 3 is a perspective side view of the exemplary reservoir dispenser valve depicted in FIG. 2 coupled to a water bottle in accordance with one aspect of the present application.

Referring to FIGS. 2 and 3, the dispenser valve 70 of FIG. 1 may be a reservoir dispenser valve 110 (hereinafter dispenser valve 110). In accordance with one embodiment the dispenser valve 110 is a removable dispenser valve. As may be shown in FIG. 3, the dispenser valve 110 may be removably coupled to a supply bottle 94 with a bottle union 103. The dispenser valve 110 may control a flow of a liquid from the supply bottle 94. The dispenser valve 110 is generally not vented, and may require that prior to usage, a vent hole 97 be administered to the supply bottle 94 in order for liquid to flow adequately through dispenser valve 110 and out of a valve body outlet port 77 when a valve activation lever 93 is activated. The dispenser valve 110 may contain the reservoir 81. The reservoir 81 may allow for the transfer of a predetermined amount of liquid from the supply bottle 94 into the reservoir 81. This transfer of liquid may drop a liquid level 98 in the supply bottle 94 to a predetermined level. The dropped liquid level may allow for the vent hole 97 to be administered to the supply bottle 94 without the liquid in the supply bottle 94 escaping through the vent hole 97.

Figure 2V:
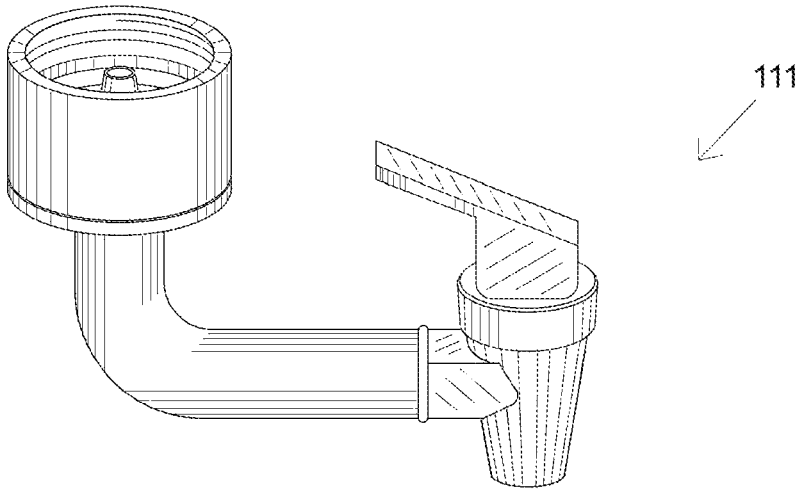
FIG. 2V is a perspective side view of an exemplary vented dispenser valve used with the exemplary water bottle dispenser in accordance with one aspect of the present application.
Figure 3V:
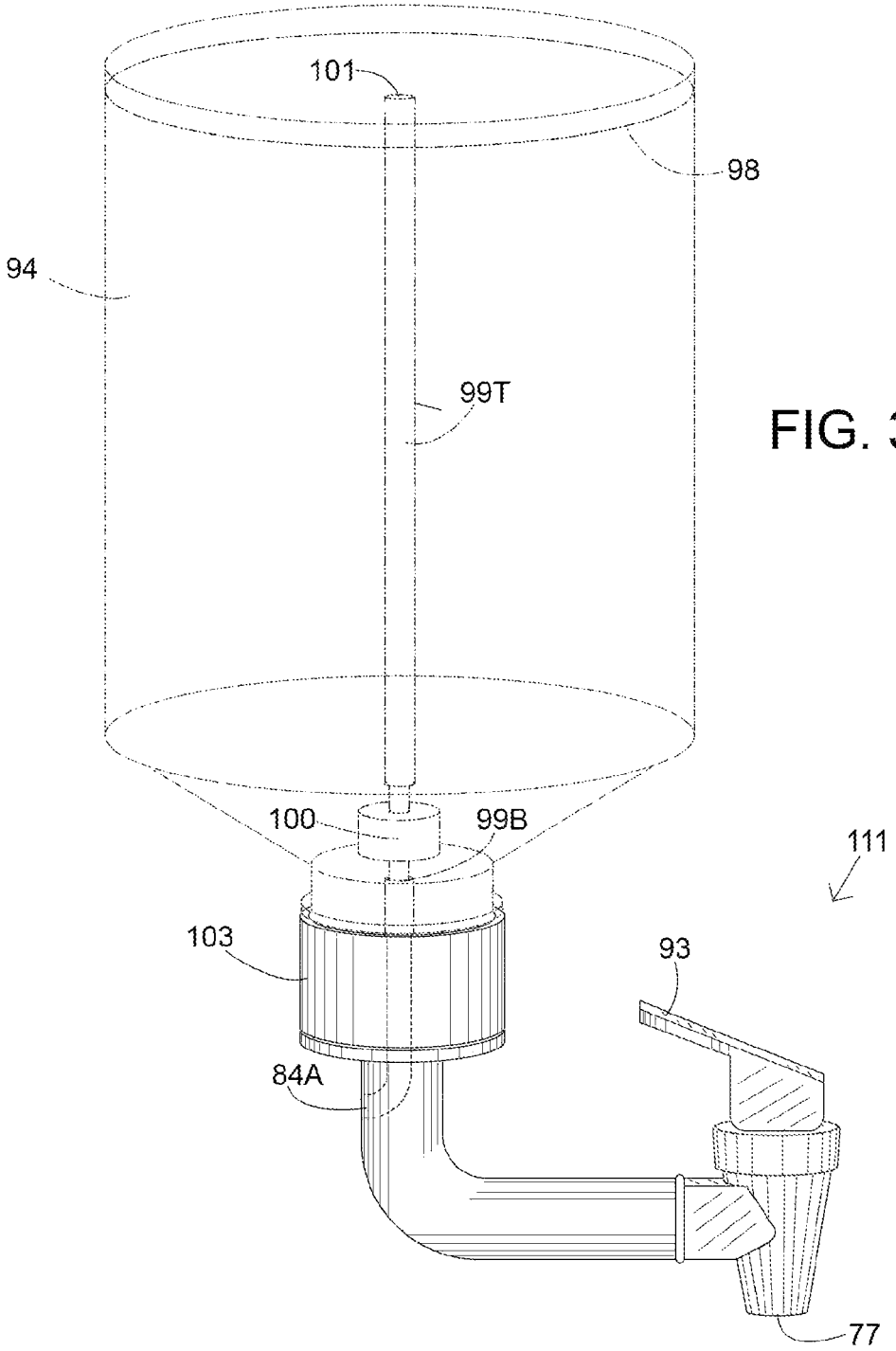
FIG. 3V is a perspective side view of the exemplary vented dispenser valve depicted in FIG. 2V coupled to a water bottle in accordance with one aspect of the present application.

Referring to FIGS. 2V and 3V, the dispenser valve 70 of FIG. 1 may be a vented dispenser valve 111 (hereinafter dispenser valve 111). In accordance with one embodiment, the dispenser valve 111 is a removable dispenser valve. As may be shown in FIG. 3V, the dispenser valve 111 may be removably coupled to supply bottle 94 with bottle union 103. The dispenser valve 111 may control the flow of the liquid from the supply bottle 94. The dispenser valve 111 may be used with a check valve 100. When using the dispenser valve 111, a vent hole may not be required in supply bottle 94. Air may enter the dispenser valve 111 through a vent tube inlet port 84A. The air may then enter a bottom tube 99B and flow through check valve 100, and exit a top tube 99T into the supply bottle 94 through a tube inlet 101. The check valve 100 may function quietly as long as the liquid level 98 of the supply bottle 94 is below the tube inlet 101 of the top tube 99T as this may prevent liquid from entering the check valve 100. It should be noted that the dispenser valve 111 might operate without the tube 99T. However, if the tube 99T is used, the dispenser valve 111 may operate in a quieter manner. When a valve activation lever 93 is activated, liquid may flow through the dispenser valve 111 and exit at valve body outlet port 77. Any bottle used with the dispenser valve 111 may be removed from the dispenser at any time, turned upright, and placed back in a refrigerator if needed.

Figure 4:
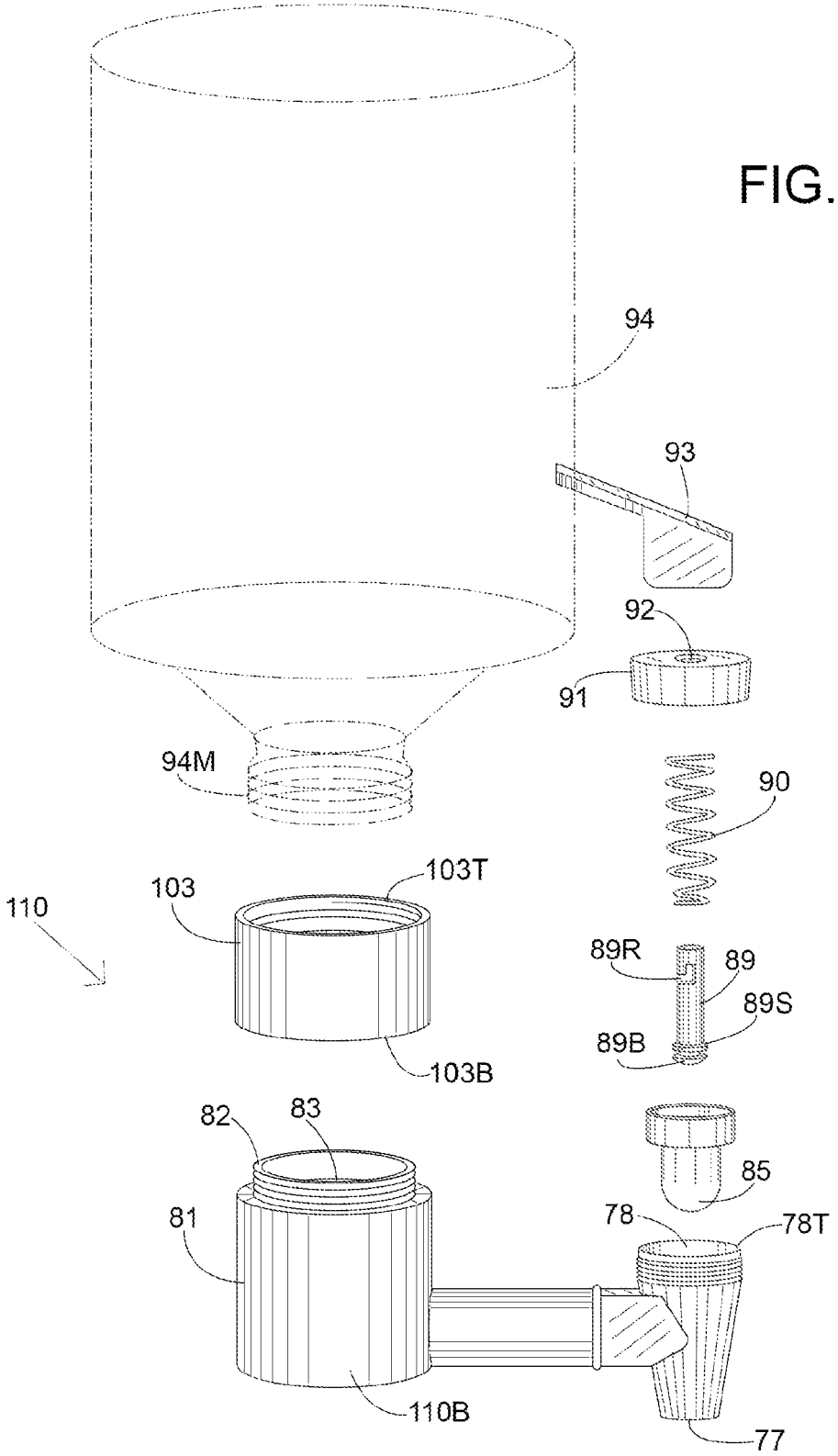
FIG. 4—is an exploded view of the exemplary reservoir dispenser valve coupled to a water bottle of FIG. 3 in accordance with one aspect of the present application.

Referring to FIG. 4, and an exploded view of FIG. 3 may be seen. In FIG. 4, the supply bottle 94 and the dispenser valve 110 are illustrated. A union bottom 103B of the bottle union 103 may be threadably secured to a valve body inlet port top 82, and a bottle mouth 94M of the supply bottle 94 may be threadably secured to a bottle union top 103T of bottle union 103. A valve body inlet port 83, a reservoir 81, and a valve body outlet port 77 of a valve body 110B may be in liquid communication with one another. The valve body 110B of dispenser valve 110 may be formed to deliver the liquid from supply bottle 94 to location to a side of the mouth 94M of the supply bottle 94. A component compartment 78, a rubber seat cup 85, and a peg base 89B of a peg 89 may be seen. The peg base 89B may anchor into the seat cup 85. A spring base 89S is where a coil spring 90 may rest when the dispenser valve 110 is assembled. A right pin slot 89R of peg 89 may be seen. The peg 89 may fit inside of the coiled spring 90. A peg aperture 92 of a component compartment bonnet 91 may be seen. Component compartment bonnet 91 may force up against the coil spring 90 when dispenser valve 110 is fully assembled. The peg aperture 92 of component compartment bonnet 91 may be where peg 89 passes through component compartment bonnet 91 so that peg 89 can attach to valve activation lever 93. Component compartment bonnet 91 may be threadably secured onto a threaded component compartment top 78T.

Figure 4V:
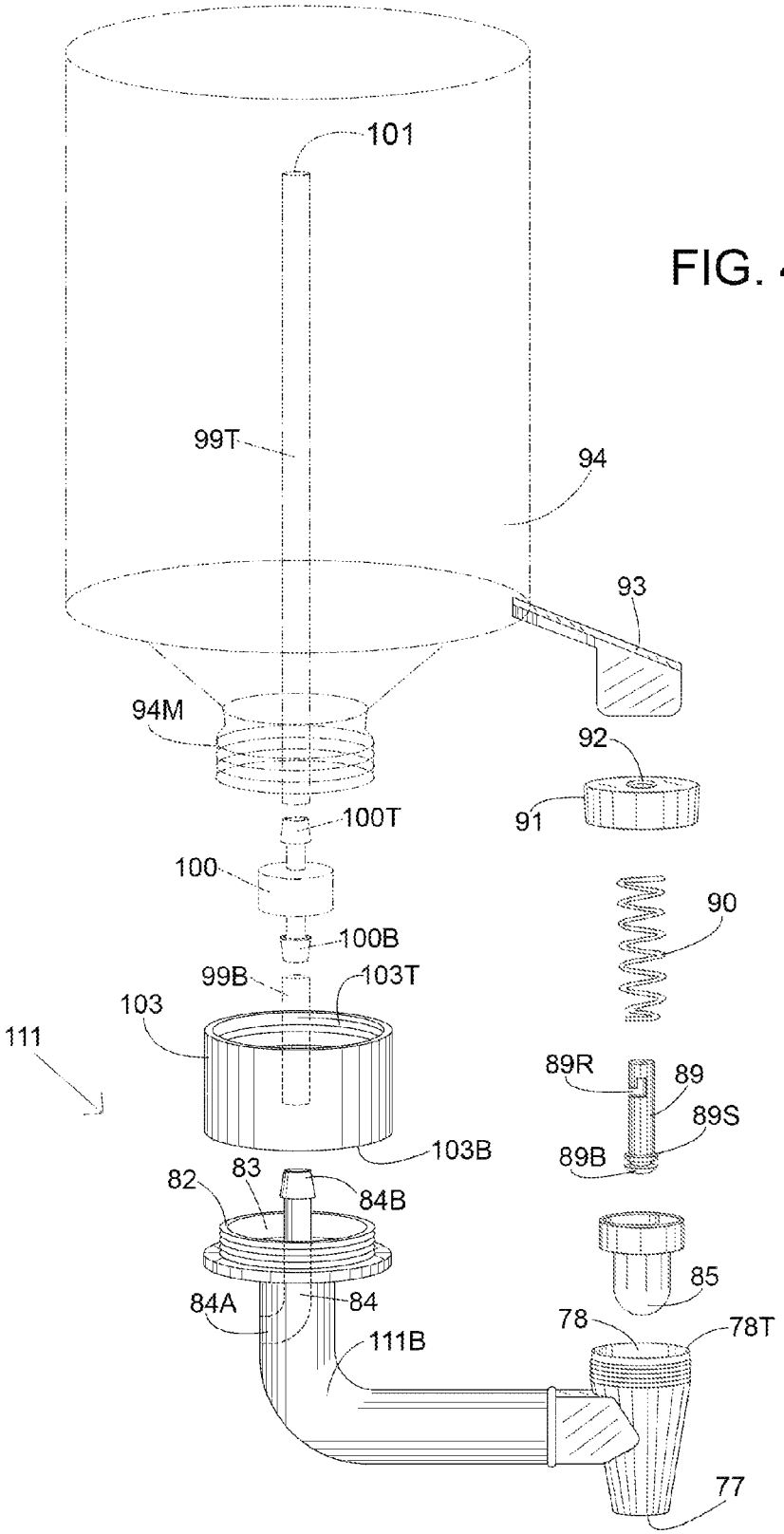
FIG. 4V—is an exploded view of the exemplary vented dispenser valve coupled to a water bottle of FIG. 3V in accordance with one aspect of the present application.

Referring to FIG. 4V, an exploded view of FIG. 3V may be seen. In FIG. 4V, the supply bottle 94 and the dispenser valve 111 may be seen. The union bottom 103B of the bottle union 103 may be threadably secured to the valve body inlet port top 82, and the bottle mouth 94M of the supply bottle 94 may be threadably secured to the union top 103T of the bottle union 103. The valve body inlet port 83 and valve body outlet port 77 may be in liquid communication with a valve body 111B. The valve body 111B of dispenser valve 111 may be formed to deliver the liquid from supply bottle 94 to location to a side of the mouth 94M of the supply bottle 94. A vent tube inlet port 84A may be where air enters the valve body 111B, flows through the vent tube 84, and exits at a barbed vent tube port 84B. The barbed vent tube port 84B may couple to a tube 99B, and the tube 99B may couple to the check valve 100 at a bottom barbed inlet 100B. The tube 99T may couple to the check valve 100 at a top barbed inlet 100T. When the dispenser valve 111 is fully assembled and coupled to supply bottle 94, air may enter the dispenser valve 111 at the vent tube inlet port 84A, and air may exit tube 99T at the tube outlet 101, which may allow air to enter the supply bottle 94, and liquid may freely from the valve body outlet port 77 when the valve activation lever 93 is activated. To the right of the valve body 111B may be the component compartment 78, and the threaded component compartment top 78T. Located above the component compartment 78 may be a seat cup 85, and a peg base 89B of the peg 89. The peg 89 may be anchored into the seat cup port 85. The coil spring 90 may surround the peg 89 and may sit on the spring base 89S of the peg 89 when the dispenser valve 111 is assembled. A right pin slot 89R of the peg 89 may be seen. The peg aperture 92 of the component compartment bonnet 91 may also be seen. The component compartment bonnet 91 may force up against the coil spring 90 when the dispenser valve 111 is fully assembled. The peg aperture 92 of the component compartment bonnet 91 may be where the peg 89 passes through the component compartment bonnet 91 so that the peg 89 may attach to the valve activation lever 93. The component compartment bonnet 91 may be threadably secured to the component compartment top 78T.

Figure 5:
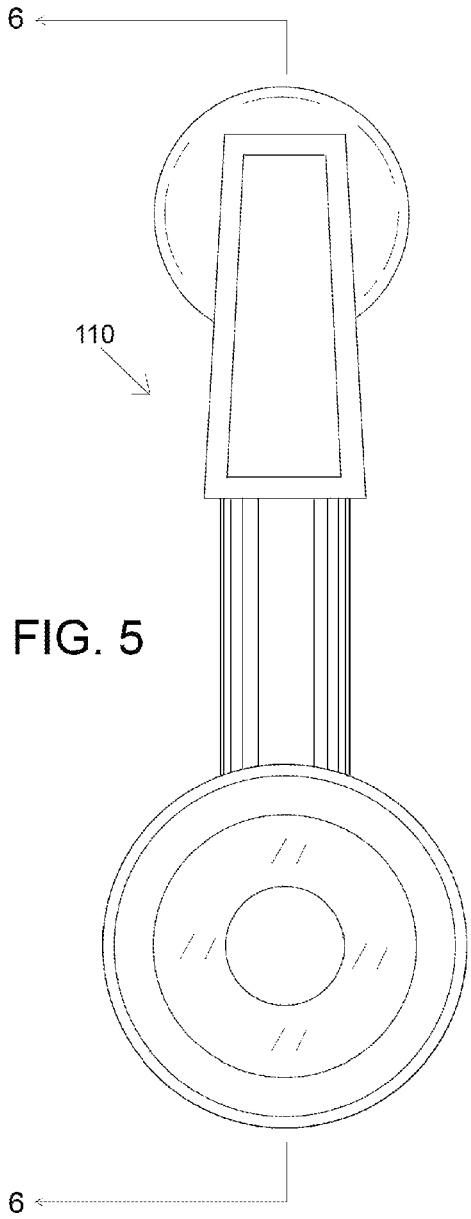
FIG. 5 is a top view of the exemplary reservoir dispenser valve of FIG. 2 in accordance with one aspect of the present application.
Figure 6:
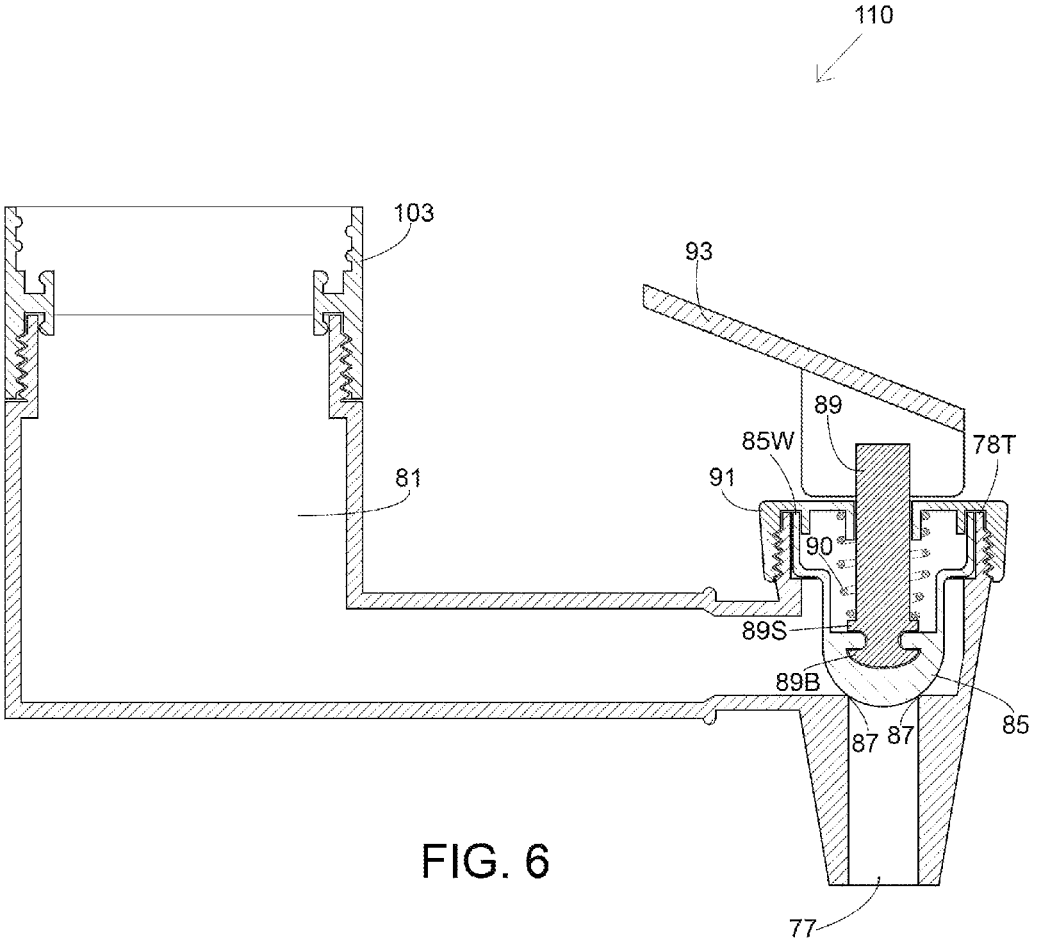
FIG. 6 is a sectional view of the exemplary reservoir dispenser valve shown in FIG. 5 taken at the sectioning plane in the direction indicated by section lines 6-6 in accordance with one aspect of the present application.

Referring to FIGS. 5 and 6, wherein FIG. 5 is an orthogonal top view of the dispenser valve 110 of FIG. 2 and FIG. 6 is sectional view taken at the sectioning plane in the direction indicated by section lines 6-6 of FIG. 5, the bottle union 103 may be attached to the dispenser valve 110. The valve activation lever 93 may move the peg base 89B, which moves the seat cup 85 upward by pulling the peg 89 further to the outside of the component compartment bonnet 91 when the valve activation lever 93 is activated. The coil spring 90 may rest on the spring base 89S of the peg 89, and push up against the component compartment bonnet 91 which may urge the seat cup 85 downward against a sealing seat 87 when the valve activation lever 93 is in a resting position as may be seen. The sealing seat 87 may be in liquid communication with the valve body inlet port 83, and the valve body outlet port 77. The component compartment bonnet 91 may be contiguous with the seat cup wall 85W to prevent any liquid leakage, and may be threadably secured onto the component compartment top 78T. The valve reservoir 81 and the valve body outlet port 77 as discussed above may also be seen.

Figure 5V:
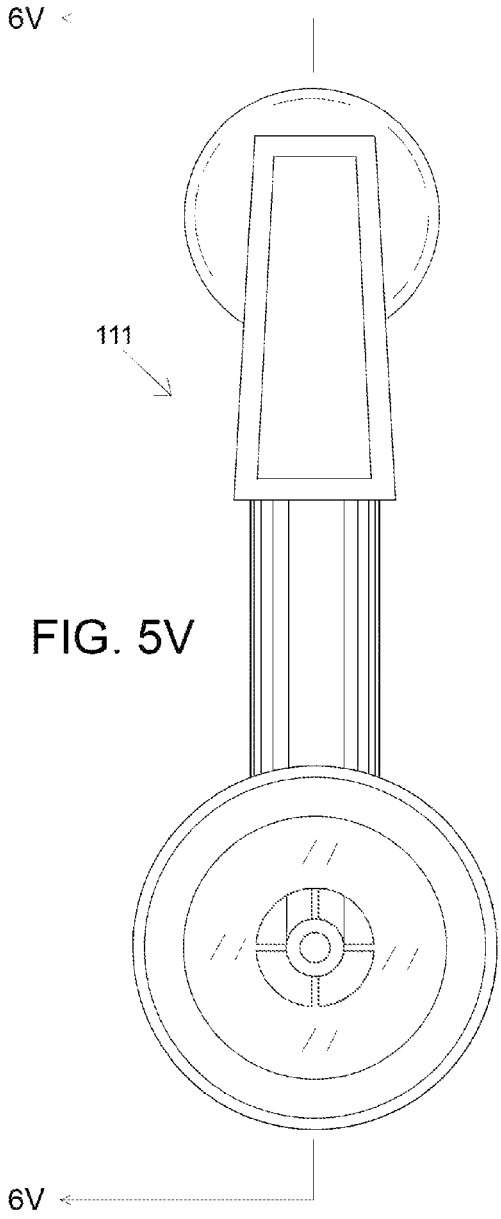
FIG. 5V is a top view of the exemplary vented dispenser valve of FIG. 2V in accordance with one aspect of the present application.
Figure 6V:
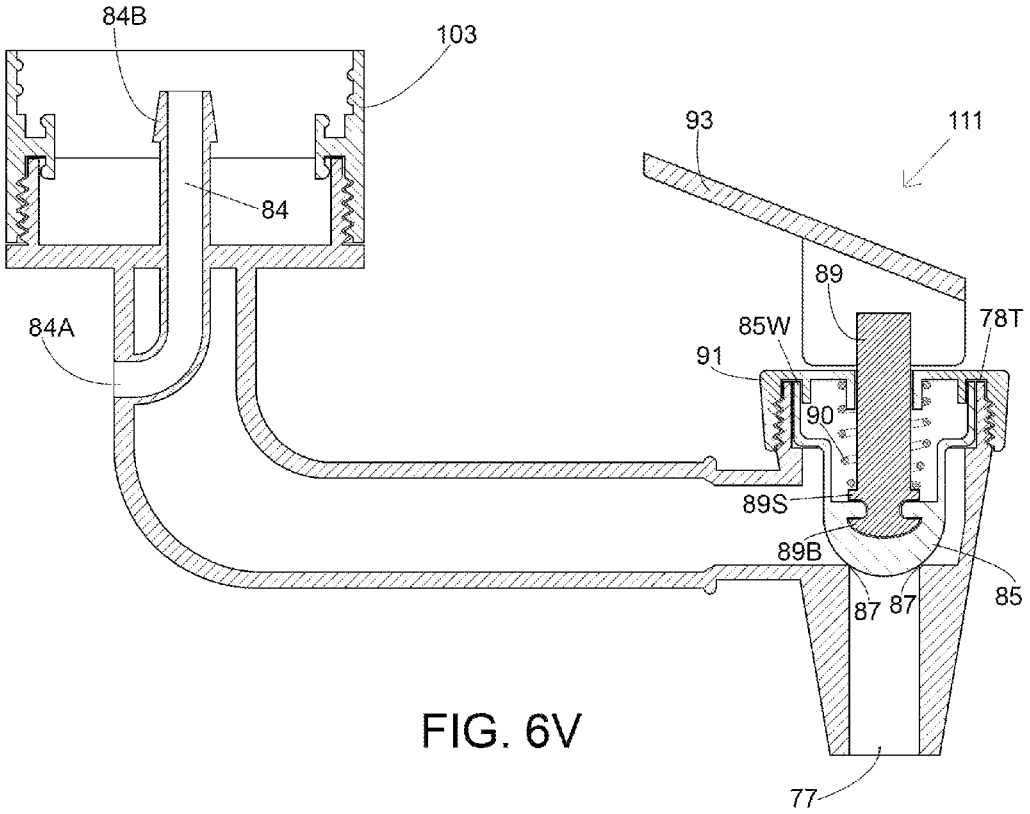
FIG. 6V is a sectional view of the exemplary vented dispenser valve shown in FIG. 5V taken at the sectioning plane in the direction indicated by section lines 6V-6V in accordance with one aspect of the present application.

Referring to FIGS. 5V and 6V, wherein FIG. 5V is an orthogonal top view of the valve 111 of FIG. 2V and FIG. 6V is sectional view taken at the sectioning plane in the direction indicated by section lines 6V-6V of FIG. 5V, the bottle union 103 may be attached to the dispenser valve 111. Air may enter the vent tube 84 that begins at vent tube inlet port 84A, travel through the vent tube 84, and exit the barbed vent tube outlet port 84B. The valve activation lever 93 may move the peg base 89B when the valve activation lever 93 is activated. The peg base 89B may move the seat cup 85 upward by pulling the peg 89 further to the outside of component compartment bonnet 91. The coil spring 90 may rest on the spring base 89S of the peg 89, and push up against the component compartment bonnet 91, which may urge the seat cup 85 downward against the sealing seat 87 when the valve activation lever 93 is in the resting position as may be seen. The sealing seat 87 may be in liquid communication with the valve body inlet port 83, and the valve body outlet port 77. The component compartment bonnet 91 may be contiguous with a seat cup wall 85W, and threadably secured onto the component compartment top 78T. Liquid may exit the dispenser valve 111 at valve body outlet port 77.

Figure 7:
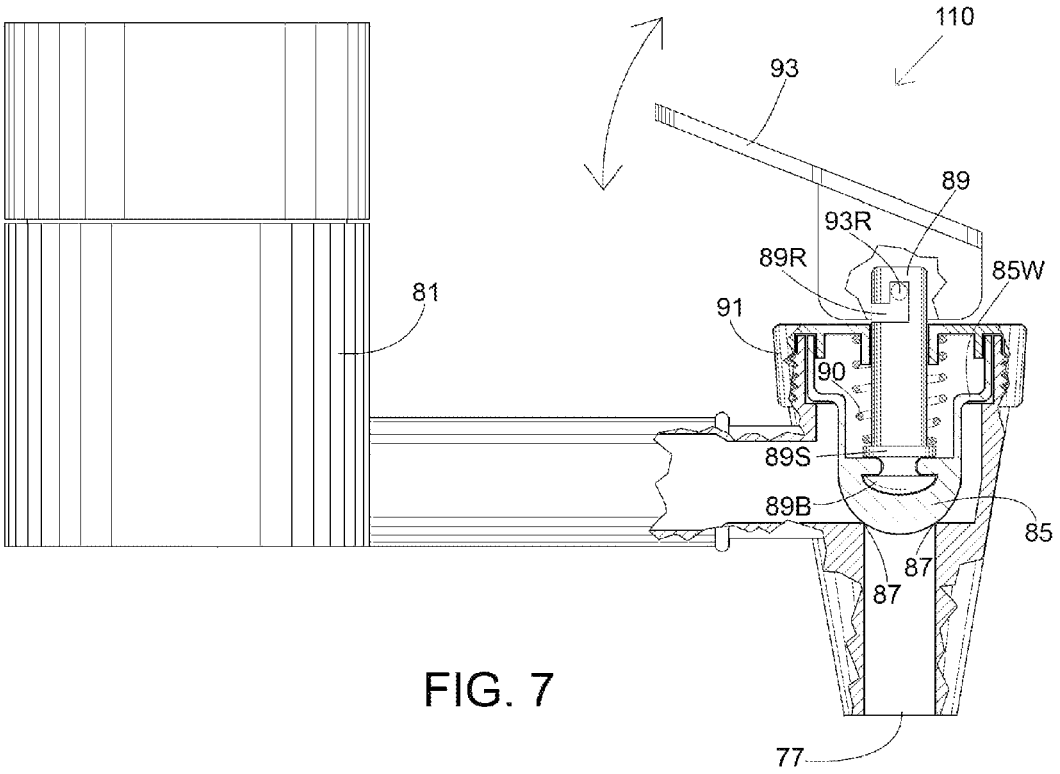
FIG. 7 is a broken orthogonal side view of the exemplary reservoir dispenser valve of FIG. 2 in accordance with one aspect of the present application.

Referring to FIG. 7, the valve activation lever 93 of the dispenser valve 110 may be depicted in a resting position. When the valve activation lever 93 is resting, the seat cup 85 may be urged against the sealing seat 87, which may halt the flow of liquid from the reservoir 81 from making its way through the valve body outlet port 77. The coil spring 90 may push up against the component compartment bonnet 91 and the spring base 89S of the peg 89. With the seat cup 85 attached to the peg base 89B, the seat cup 85 may be urged against sealing seat 87 which may halt the flow of liquid through the dispenser valve 110. Thus seat cup wall 85W may be in a straight position. The right pin slot 89R can be where a right pin 93R of the valve activation lever 93 engages with the peg 89.

Figure 7V:
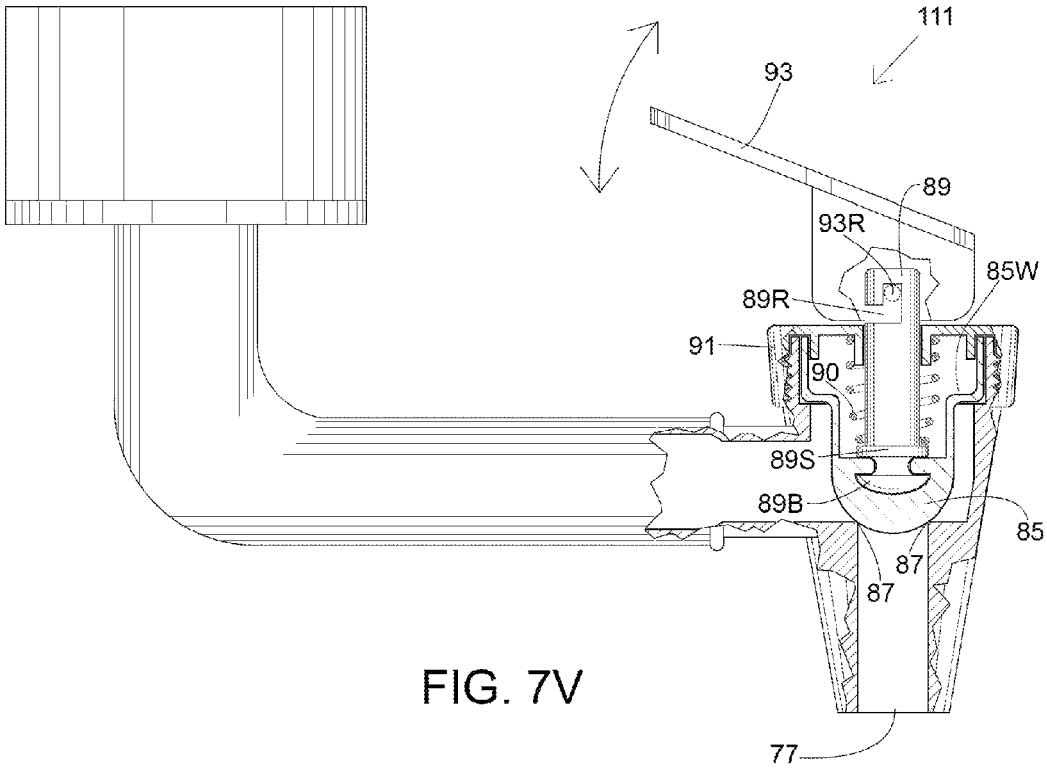
FIG. 7V is a broken orthogonal side view of the exemplary vented dispenser valve of FIG. 2V in accordance with one aspect of the present application.

Referring to FIG. 7V, the workings of dispenser valve 111 may be similar to that of the dispenser valve 110 disclosed above with reference to FIG. 7 when the dispenser valve 111 is in resting position. As with the dispenser valve 110, when the valve activation lever 93 is resting, the seat cup 85 may be urged against the sealing seat 87, which may halt the liquid from making its way through the valve body outlet port 77. Thus the seat cup wall 85W is in a straight position. The coil spring 90 may push against the component compartment bonnet 91 and the spring base 89S of the peg 89, and with the seat cup 85 attached to the peg base 89B, the seat cup 85 may be urged against the sealing seat 87 which may halt the liquid from flowing through the dispenser valve 111. The right pin slot 89R may be where the right pin 93R of valve activation lever 93 engages with the peg 89.

Figure 8:
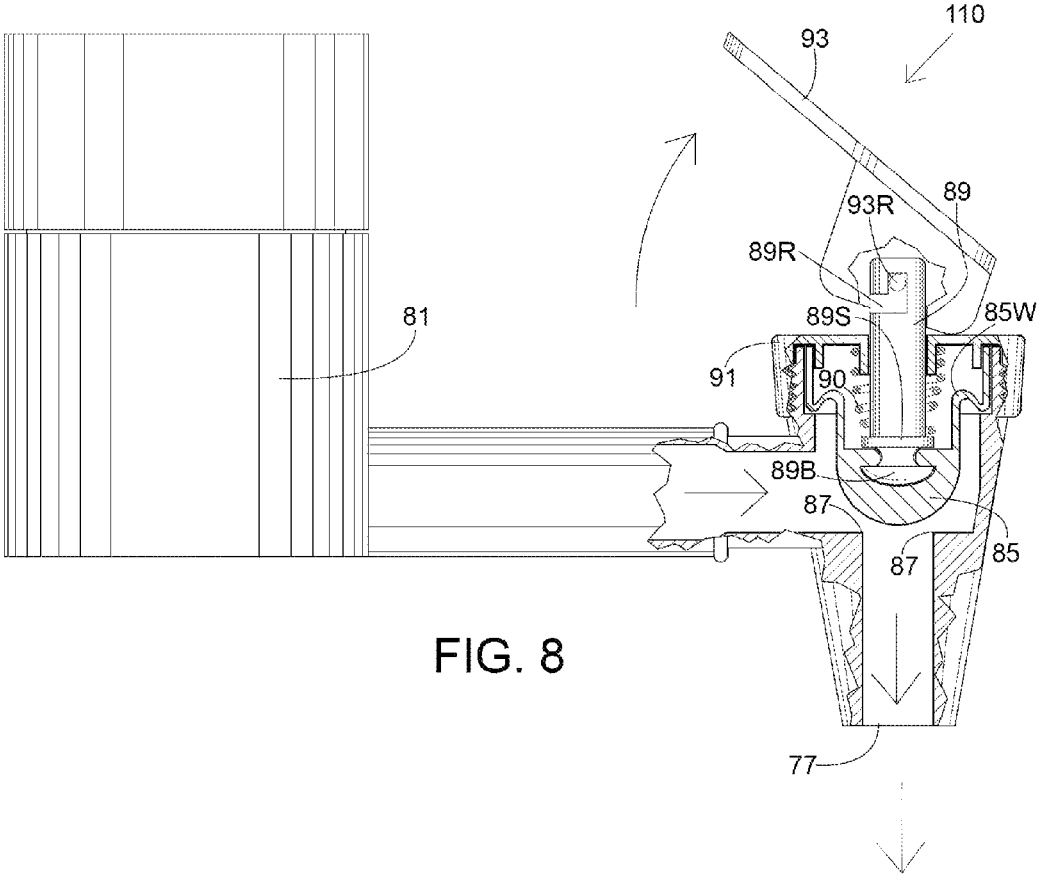
FIG. 8 is a broken orthogonal side view of the exemplary reservoir dispenser valve of FIG. 2 in accordance with one aspect of the present application.

Referring to FIG. 8, the valve activation lever 93 of the dispenser valve 110 may be moved forward. When the valve activation lever 93 is moved forward, the right pin 93R and a left pin 93L (see FIG. 10), of the valve activation lever 93, that are inserted into the right pin slot 89R and a left pin slot 89L (see FIG. 10) of peg 89, may pull the peg base 89B of the peg 89 upward. When the peg 89 moves upward, it may pull the seat cup 85 away from the sealing seat 87 by compressing the coil spring 90 up against the coiled spring base 89S of the peg 89 and the component compartment bonnet 91. The liquid may then flow through the dispenser valve 110 from the reservoir 81 and may pass through the valve body outlet port 77. Thus, the seat cup wall 85W may be in a flexed position.

Figure 8V:
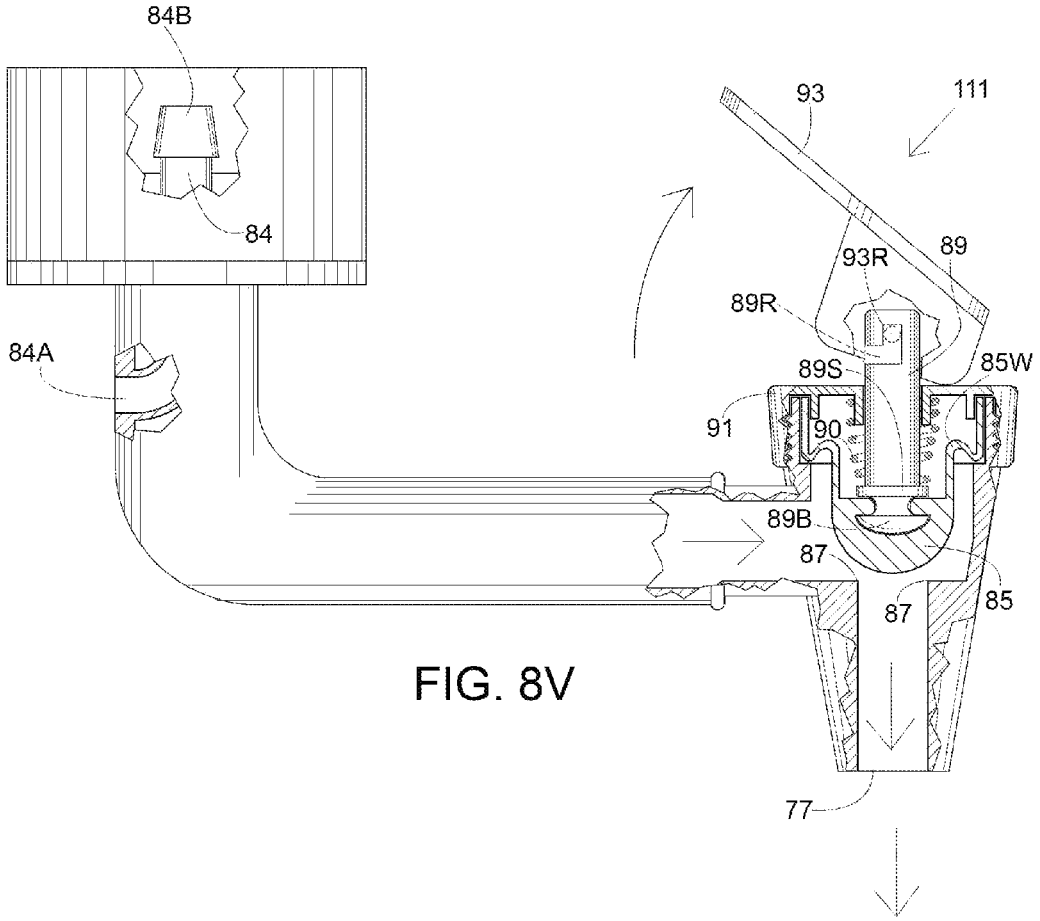
FIG. 8V is a broken orthogonal side view of the exemplary vented dispenser valve of FIG. 2V in accordance with one aspect of the present application.

Referring to FIG. 8V, the valve activation lever 93 of the dispenser valve 111 may be seen moved forward. The operation is similar to the operation disclosed in FIG. 8. However, in this embodiment, the vent tube 84 may pull air into the supply bottle (not shown) that is in union with the dispenser valve 111. When the valve activation lever 93 is moved forward, the right and left pins 93R and 93L (see FIG. 10) of the valve activation lever 93, that are inserted into the right and left pin slots 89R and 89L (see FIG. 10) of peg 89, may pull the peg base 89B of the peg 89 upward. When the peg 89 moves upward, it may pull the seat cup 85 away from sealing seat 87 by compressing the coil spring 90 up against the peg coiled spring base 89S and the component compartment bonnet 91. Air may then flow into the vent tube inlet port 84A and through the barbed vent tube port 84B. When in use, the liquid may then flow through the dispenser valve 111 and pass through the valve body outlet port 77. Thus, the seat cup wall 85W may be in a flexed position.

Figure 9:
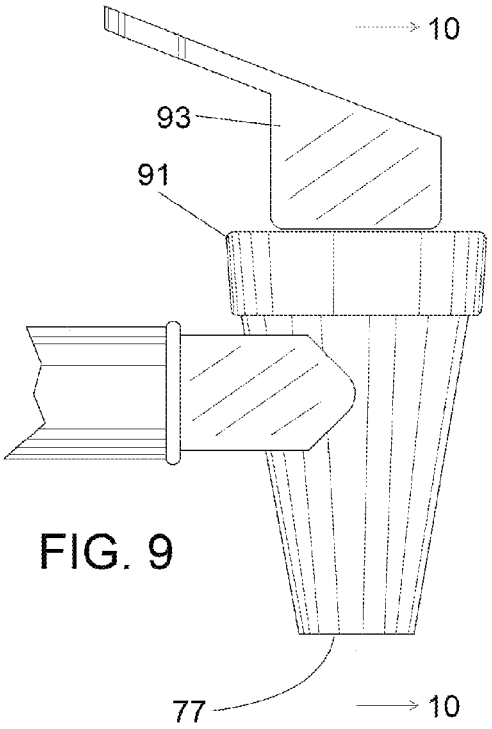
FIG. 9 is broken orthogonal side view illustrating the exemplary reservoir dispenser valve of FIG. 2 and the exemplary of vented dispenser valve FIG. 2V in accordance with one aspect of the present application.
Figure 10:
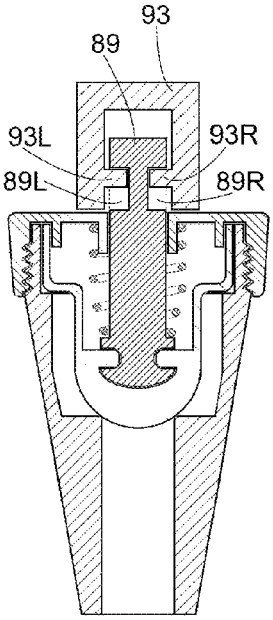
FIG. 10 is a sectional view of FIG. 9 taken at the sectioning plane in the direction indicated by section lines 10-10 in accordance with one aspect of the present application.

Referring to FIG. 10, a sectional view of FIG. 9 taken at the sectioning plane in the direction indicated by section lines 10-10, the component compartment bonnet 91, the valve activation lever 93, and the valve body outlet port 77 of the dispenser, valves depicted in FIGS. 2 and 2V may be shown. In the FIG. 10, the right and left pins 93R and 93L of the valve activation lever 93 may be seen along with the right and left pin slots 89R and 89L of the peg 89, showing how the valve activation lever 93 may engage the peg 89 and may activate the dispenser valve in FIG. 9.

Figure 11:
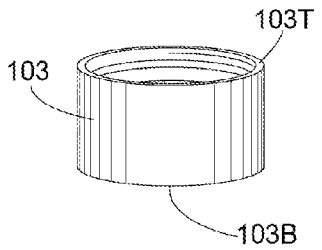
FIG. 11 is a perspective view of an exemplary bottle union used with the exemplary water bottle dispenser in accordance with one aspect of the present application.

Referring to FIG. 11, a perspective view of the bottle union 103 may be seen. The bottle union 103 has a union bottom 103B that couples to the dispenser valve 110 and/or dispenser valve 111 of FIGS. 4 and 4V. Threads may be formed within an interior perimeter of the bottle union 103. The threads may be used to engage threads formed on the dispenser valve 110 and dispenser valve 111 of FIGS. 4 and 4V respectively. A top 103T of the bottle union 103 may be configured so that the threads formed in the interior of the bottle union 103 engage with threads formed on a mouth of the supply bottle 94.

Figure 12:
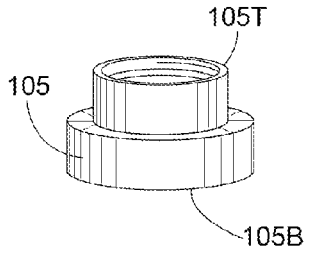
FIG. 12 is a perspective view of an exemplary bottle union used with the exemplary water bottle dispenser in accordance with one aspect of the present application.

FIG. 12 illustrates a perspective view of another embodiment of a bottle union, bottle union 105. The same functionality of bottle union 103 may apply to bottle union 105. However, in the embodiment of FIG. 12, a top diameter of a union top 105T may be smaller than a bottom diameter of a union bottom 105B. The union top 105T may be configured to fit the threaded mouth of the supply bottle 94 in which the diameter of the specific bottle mouth is smaller than the union bottom 105B that engages with the dispenser valve 110 and/or dispenser valve 111 of FIGS. 4 and 4V respectively.

Figure 13:
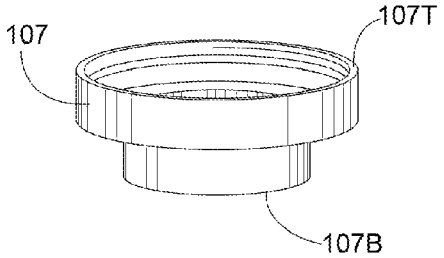
FIG. 13 is a perspective view of an exemplary bottle union used with the exemplary water bottle dispenser in accordance with one aspect of the present application.

FIG. 13 illustrates a perspective view of another embodiment of a bottle union, bottle union 107. The same functionality of bottle unions 103 and/or 105 applies to the bottle union 107. However, in the embodiment of FIG. 13, a top diameter of a union top 107T is larger than a bottom diameter of a union bottom 105B. The union top 107T is configured to fit the threaded mouth of the supply bottle 94 in which the diameter of the specific bottle mouth is larger than the union bottom 107B that engages with dispenser valve 110 and/or dispenser valve 111 of FIGS. 4 and 4V respectively.

Figure 14:
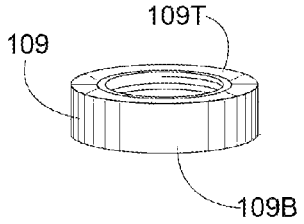
FIG. 14 is a perspective view of an exemplary bottle union used with the exemplary water bottle dispenser in accordance with one aspect of the present application.

Another embodiment of a bottle union, bottle union 109 is illustrated in FIG. 14. The bottle union 109 may locate the threads of a union top 109T that couples to a bottle mouth 94M of FIGS. 4 and 4V within the diameter of the threads of a union bottom 109B that couples with the threads of the dispenser valve top 82 of dispenser valve 110 and/or dispenser valve 111 of FIGS. 4 and 4V respectively. The result would likely be a shorter, and more compact bottle union than the bottle union 105. However, if the bottle mouth 94M, and the threaded valve top 82 are of the same diameter as in FIGS. 4 and 4V, construction of the bottle union 109 may not be possible, and the bottle union 103 would probably be used. In addition, the bottle union 109 could also be used as a substitute for the bottle union 107 if flipped. If this were the case, the threaded valve top 82 may couple to the union top 109T and the bottle mouth 94M may couple to the union bottom 109B.

Figure 15:
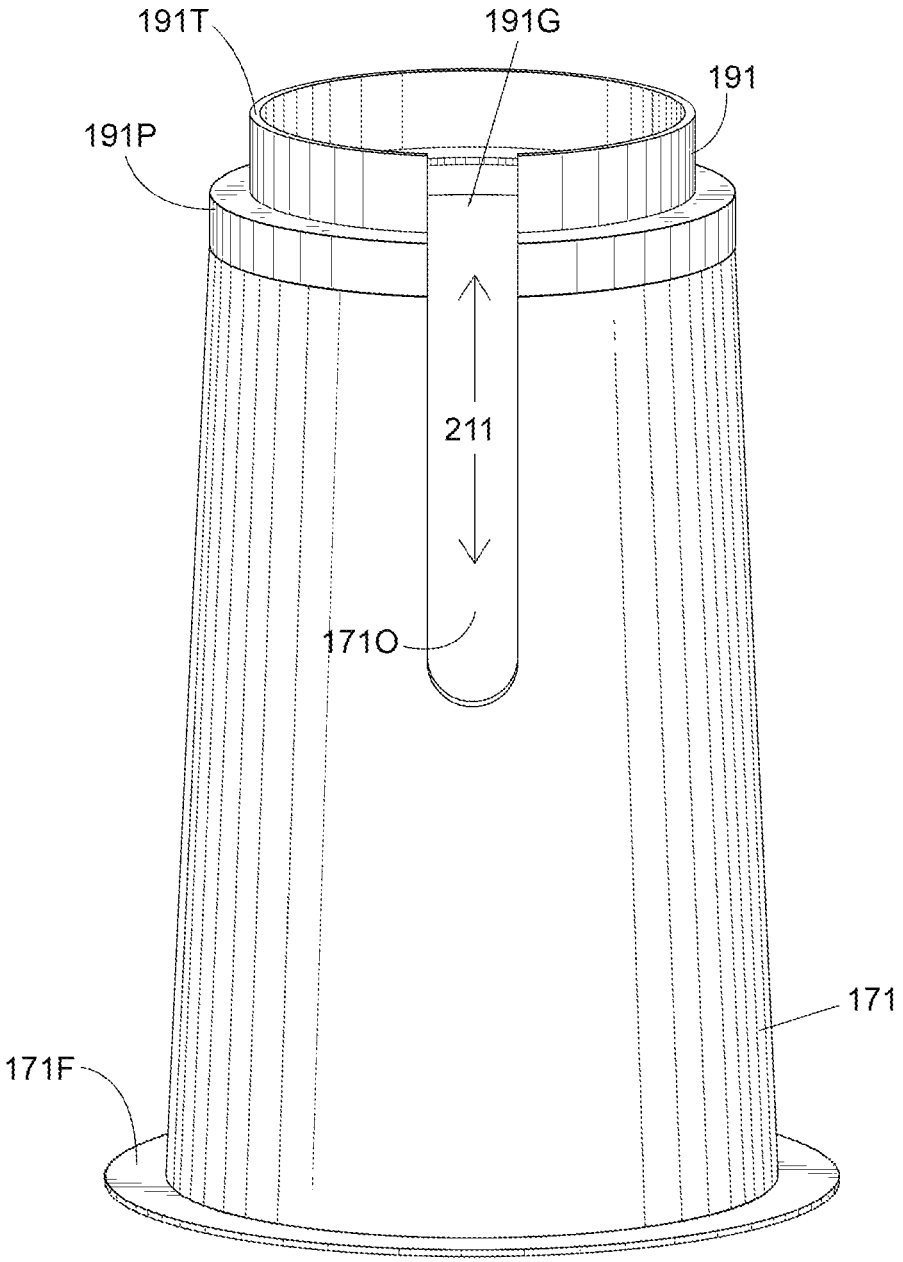
FIG. 15 is a perspective view of the front side of the exemplary water bottle dispenser in accordance with one aspect of the present application.

Referring to FIG. 15, a front view of the dispenser may be illustrated. A walled dispenser base 171 (hereinafter base 171) may be seen. A side opening 171O may be formed in a side of the base 171, and a base foot 171F may be formed at the bottom portion of the base 171. A removable bottle collar 191 (hereinafter bottle collar 191), and a side gap 191G of the bottle collar 191 may be seen along with a top enclosure 191T. The top enclosure 191T may be circular in shape. However the top enclosure 191T may be formed in additional geometrical shapes and sizes to accommodate different shapes and sizes of additional supply bottles. A bottle collar peripheral portion 191P of the bottle collar 191 may be engaged with the base 171. The bottle collar side gap 191G and the side opening 171O of the base 171 may merge to form a valve passage 211.

Figure 16:
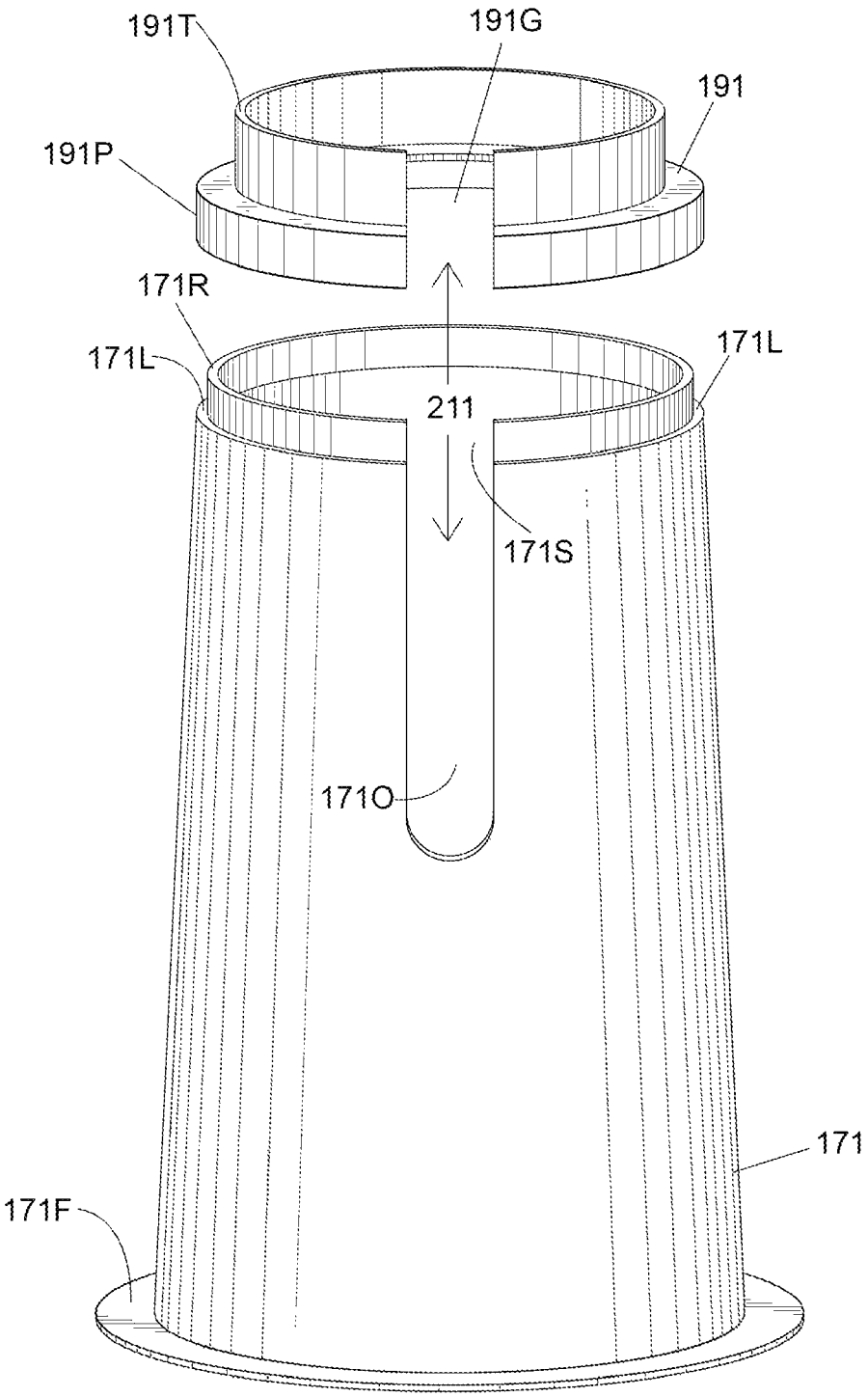
FIG. 16 is an exploded view of FIG. 15 in accordance with one aspect of the present application.

Referring to FIG. 16, an exploded view of FIG. 15 may be seen. The bottle collar 191 may be viewed separated from a hollow base 171. The top enclosure 191T of the bottle collar 191 may be formed to engage and surround a sidewall 94S the supply bottle 94 of FIG. 17. The peripheral portion 191P of the bottle collar 191 may removably engage upon a base ledge 171L on the exterior of base 171 to support the bottle collar 191 upon the base 171. A rim 171R may be formed at a top portion of the base 171. The rim 171R may have an open section 171S. The side opening 171O of the base 171 may extend upward through the open section 171S of the rim 171R. The side gap 191G of the bottle collar 191 may be aligned with the open section 171S of the rim 171R of the base 171 to form a valve passage 211. The base foot 171F may support the base 171.

Figure 17:
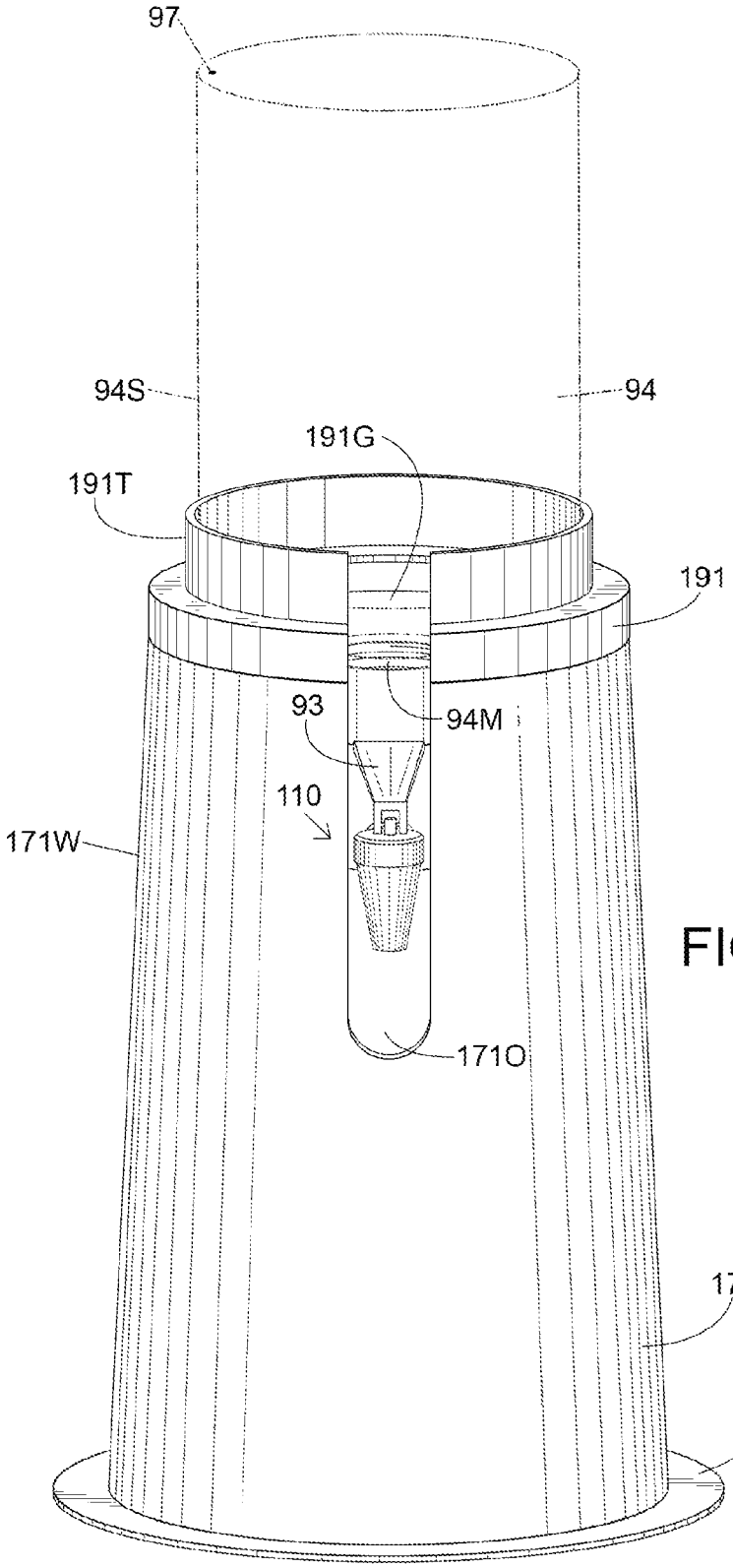
FIG. 17 is a perspective view of the front side of the exemplary water bottle dispenser in accordance with one aspect of the present application.

Referring to FIG. 17, a front view of the dispenser may be illustrated. The supply bottle 94 may be inverted and positioned into the top enclosure 191T the bottle collar 191. The side gap 191G of the bottle collar 191 may be seen. The supply bottle 94 may be circular in shape. However, the supply bottle 94 may be formed in additional shapes and sizes (not shown) that may be used with bottle collar 191. The bottle collar 191 may be removably engaged upon the base 171. The supply bottle 94 may be inverted and positioned within the bottle collar 191 while the bottle collar 191 is supported and engaged upon the base 171. The side opening 171O may be formed in a dispenser base sidewall 171W of the base 171 may enable the valve 110 coupled to the mouth 94M of the supply bottle 94 inverted and positioned within the removable bottle collar 191 to pass from the interior of the base 171 to a location outside of the base 171. The vent hole 97 may be administered in the supply bottle 94 to accommodate the dispenser valve 110 that does not have a vent. The liquid from supply bottle 94 may be delivered from the mouth 94M through the side opening 171O formed in the side of the base 171, and to a location outside of the base 171 when the valve activation lever 93 of the dispenser valve 110 is activated. In the present embodiment the dispenser valve 110 is illustrated. However, the dispenser valve 111 may be used also. The base foot 171F may also be seen in the present embodiment.

Figure 18:
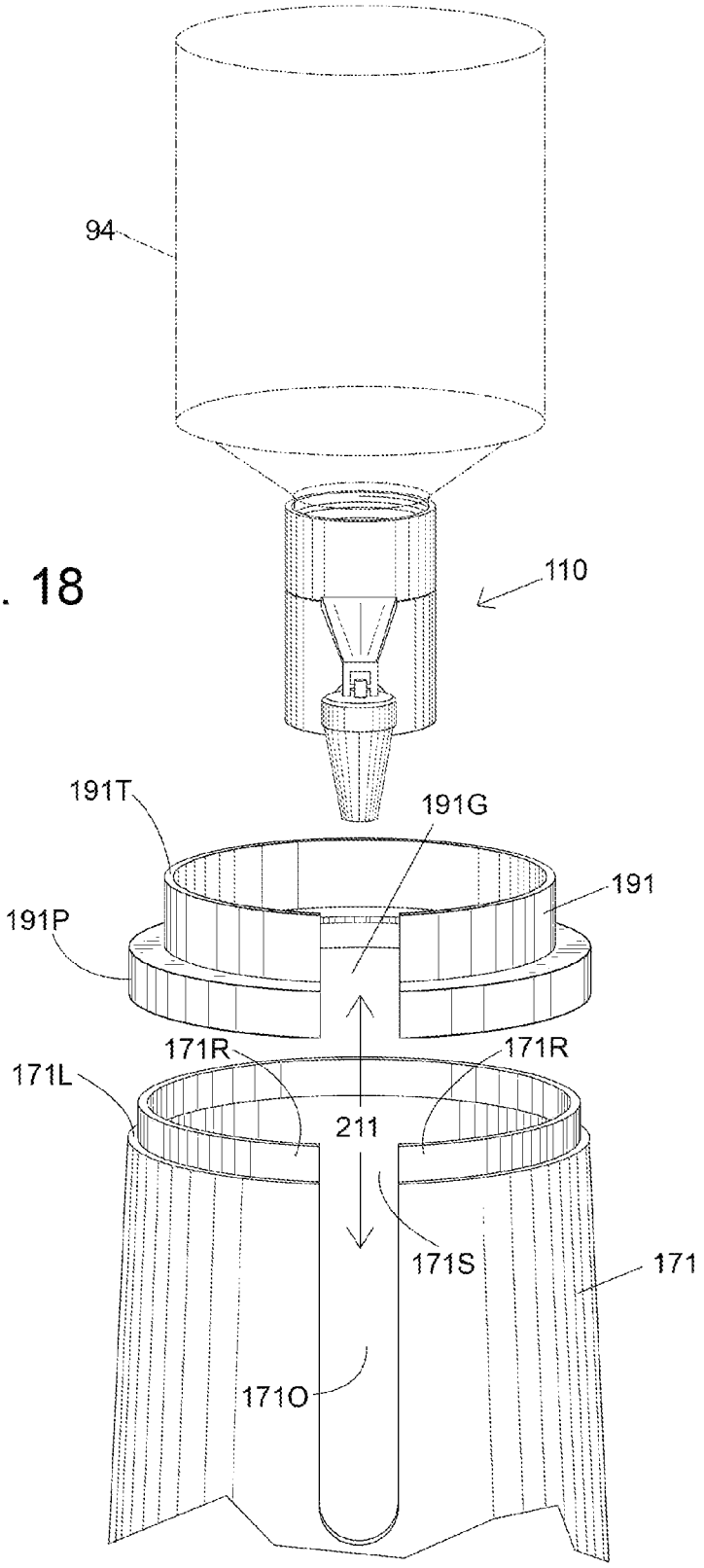
FIG. 18 is an exploded view of FIG. 17 in accordance with one aspect of the present application.

Referring to FIG. 18, an exploded view of FIG. 17 may be shown. The supply bottle 94 may be seen coupled to the dispenser valve 110. The bottle collar 191 may be seen separated from the dispenser base 171. The top enclosure 191T of the bottle collar 191 may engage the supply bottle 94. The top enclosure 191T may prevent a sideward movement of the supply bottle 94 when the supply bottle 94 may be inverted and positioned into the bottle collar 191. The peripheral portion 191P may engage and support the bottle collar 191 upon the base ledge 171L of the base 171. The side opening 171O of the base 171 may extend upward through the open section 171S of the rim 171R. The dispenser valve 110 coupled to the supply bottle 94 may be lowered directly downward into the dispenser base 171 through the side opening 171O. The valve passage 211 may be formed when the side gap 191G of the bottle collar 191 and the open section 171S of the rim 171R may align together when the bottle collar 191 may engage the base 171. The valve passage 211 may enable the valve 110 coupled to the supply bottle 94 to be lowered directly downward into the base 171 through the side gap 191G of the bottle collar 191 and the side opening 171O of the base 171.

Figure 19:
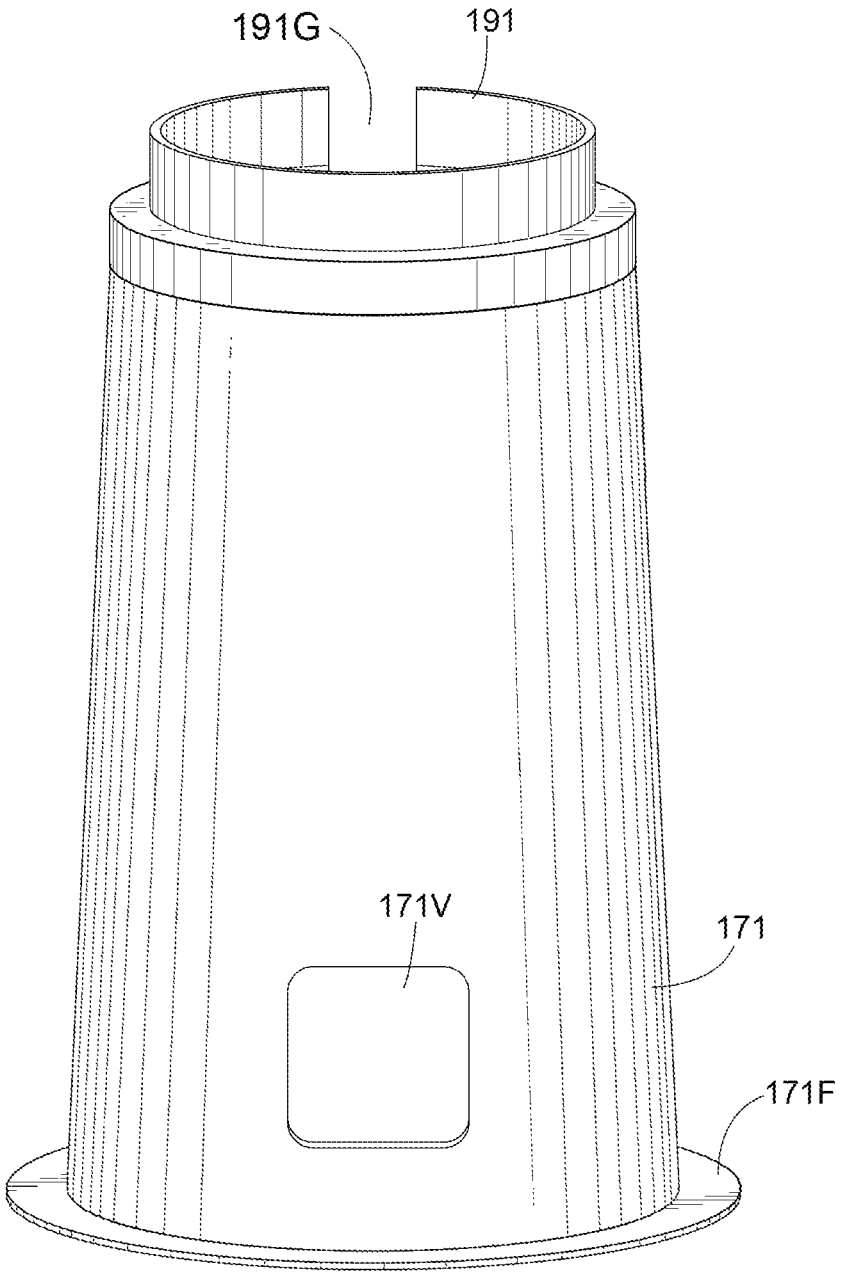
FIG. 19 is a perspective view of a backside of the exemplary water bottle dispenser in accordance with one aspect of the present application.
Figure 20:
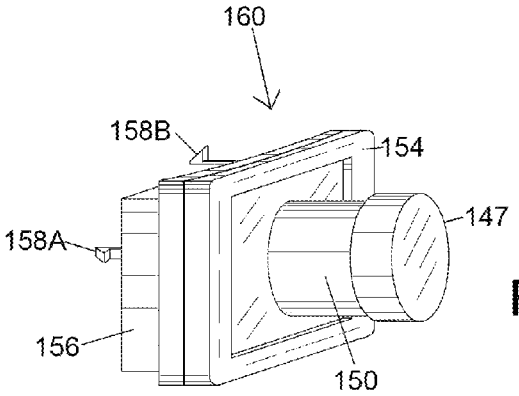
FIG. 20 is a perspective view of an exemplary retaining device assembly in accordance with one aspect of the present application.
Figure 21:
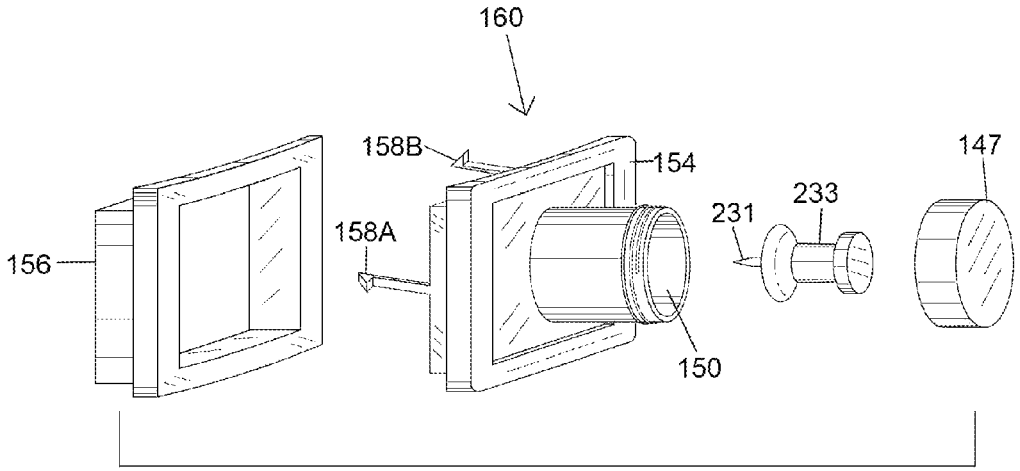
FIG. 21 is a perspective exploded view of the exemplary retaining device assembly of FIG. 20 in accordance with one aspect of the present application.

Referring to FIG. 19, a rear view of the dispenser may be seen void of a retaining device assembly 160 (as shown in to FIGS. 20 and 21). The bottle collar 191 may be seen with the side gap 191G. A retaining device void 171V may be formed in a lower part of the base 171. The retaining device void 171V may be where the retaining device assembly 160 of FIGS. 20 and 21 may be attached to the base 171. The bottle collar 191 may be removably engaged upon the base 171. The base foot 171F may be formed at a bottom portion of base 171 and may extend therefrom. The base 171 and the bottle collar 191 may be constructed of the durable plastic polypropylene or of the metal stainless steel. The base 171 may be formed to be hollow. This may allow the base 171 to be nested/stacked when void of the retaining device assembly 160 of FIG. 20. In the present embodiment, the base 171 may be cylindrical in shape and may have a circular cross section. However, this is shown as one example and the base 171 may be formed in other geometrical shapes and sizes. The base 171 could be formed to be square, hexagonal, octagonal etc. and have square, hexagonal, octagonal, or other various types of cross sectional shapes. The base 171 may be configured for placement on a counter top or configured for placement on a floor. As shown in FIG. 19, the base 171 may be tapered. Thus, a bottom portion of the base 171 may be wider than an upper portion of the base 171. The tapered nature of the base 171 may provide for the base to be stacked, and additionally may provide added stability for base 171.

Referring to FIG. 20, the retaining device assembly 160 may be seen. The retaining device assembly 160 may be constructed of the durable plastic polypropylene or of the metal stainless steel. A front plate 154 may engage with a rear mounting plate 156, and a bottle cap 147 may be threadably secured onto a threaded cylinder 150. The threaded cylinder 150 may merge with front plate 154. A barbed fastening arm 158A and a barbed fastening arm 158B of the front plate 154 may be seen and may be described below.

Referring to FIG. 21, an exploded view of FIG. 20 may be seen. In the present embodiment, the rear mounting plate 156 may be separated from the front plate 154. The threaded cylinder 150 may be where the retaining device 160 may removably attach a piercing tool 233 to the base 171. The threaded cylinder 150 may merge with the front plate 154. The bottle cap 147 may be separated from the threaded cylinder 150. A piercing tool spike 231 of the piercing tool 233 may also be seen. The barbed fastening arms 158A and 158B of front plate 154 may be seen. While the present embodiment shows two fastening arms 158A and 158B, this is shown as an example and the front plate 154 may have additional fastening arms without departing from the spirit and scope of the present invention. The bottle cap 147 may be threadably secured to the threaded cylinder 150. The external threads of the threaded cylinder 150 of the front plate 154 may be designed to mate with the internal threads of the bottle cap 147 that was removed from the supply bottle 94 shown in FIG. 22 so that the bottle cap 147 may be threadably secured onto the threaded cylinder 150.

Figure 22:
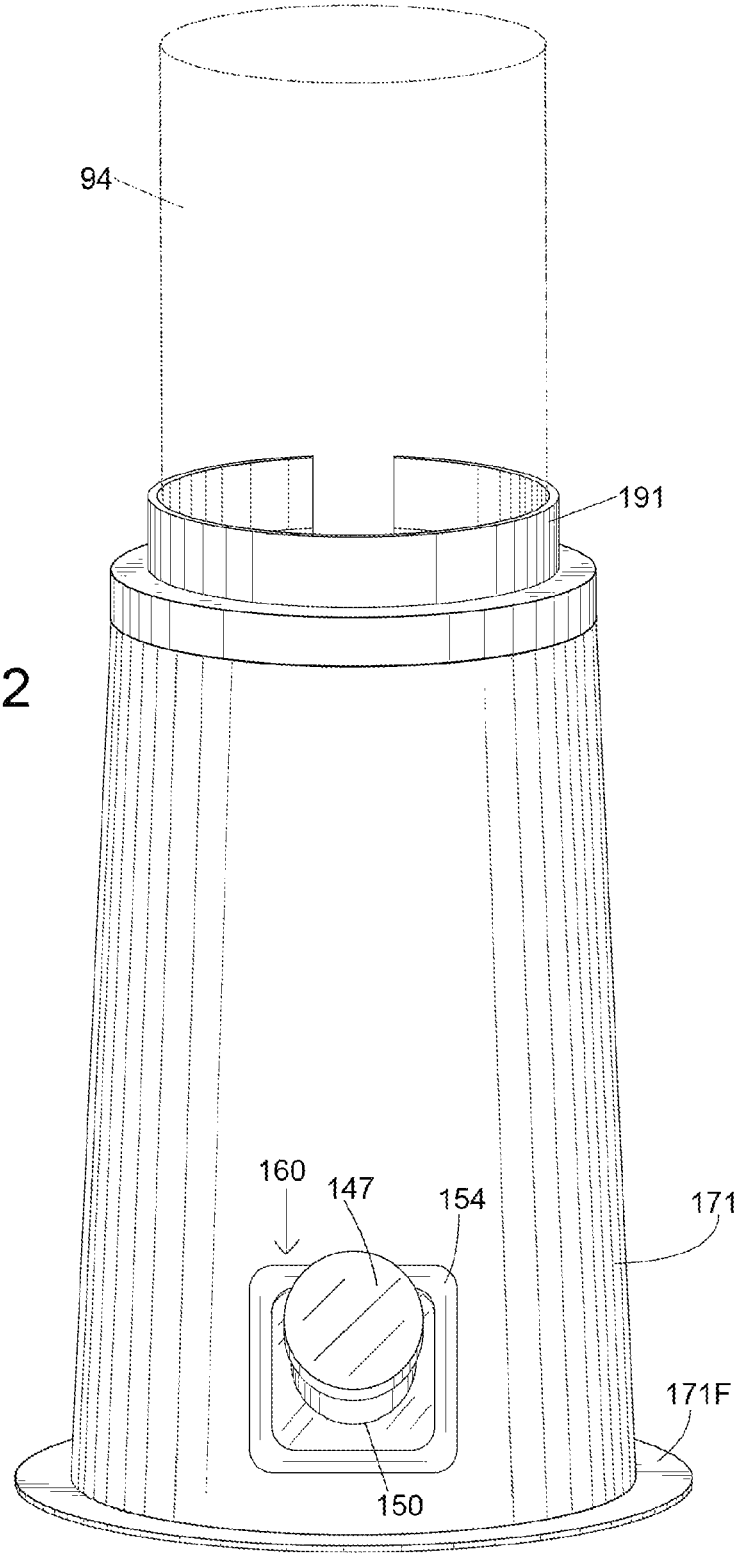
FIG. 22 is a perspective view of the backside of the exemplary water bottle dispenser and the attached exemplary retaining device in accordance with one aspect of the present application.

Referring to FIG. 22, the backside of the dispenser 171 may be viewed with the retaining device 160 attached. The front plate 154 of the retaining device 160 may be seen covering the retaining device void 171V of FIG. 19. The bottle collar 191 may be seen removably engaged upon the base 171. The bottle collar 191 may be adapted to engage and support the supply bottle 94 upon the base 171 while the supply bottle 94 may be inverted and positioned within the bottle collar 191. The bottle cap 147, which may have been removed from the supply bottle 94, may be threadably secured onto the threaded cylinder 150 of the front plate 154. The threaded cylinder 150 may be a retainer that may store and removably attach the piercing tool 233 of FIG. 21 to the base 171. The threaded cylinder 150 may have external threads that may be configured to be approximately identical to the threads of the bottle mouth 94M (FIG. 4) of the supply bottle 94. The threads of the threaded cylinder 150 of the front plate 154 may be made to mate with the threads of the bottle cap 147 that may have been removed from the supply bottle 94 so that the bottle cap 147 may be threadably secured onto the threaded cylinder 150. The base foot 171F may also be seen in the present embodiment.

Figure 23:
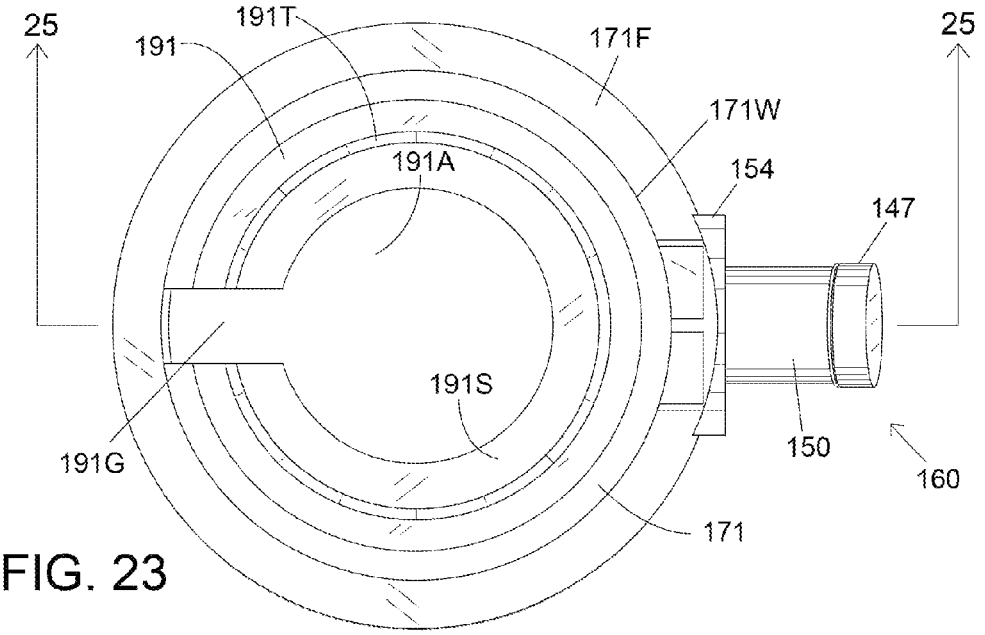
FIG. 23 is an orthogonal top view of the exemplary water bottle dispenser, with an exemplary front plate partially entered into a base wall in accordance with one aspect of the present application.

Referring to FIG. 23, a top view of the dispenser may be seen. The top enclosure 191T, a center aperture 191A, a bottle seat 191S, and a side gap 191G of the bottle collar 191 may be seen in the present embodiment. The threaded cylinder 150 of the front plate 154, the bottle cap 147, and the base foot 171F of base 171 may also be seen. The front plate 154 of the retaining device 160 may be partially entered through the dispenser base sidewall 171W (hereinafter sidewall 171W). The flexing of the barbed fastening arm 158B and a barbed fastening arm 158D when the front plate 154 may be partially entered through the sidewall 171W of the base 171 may be illustrated in FIG. 25.

Figure 24:
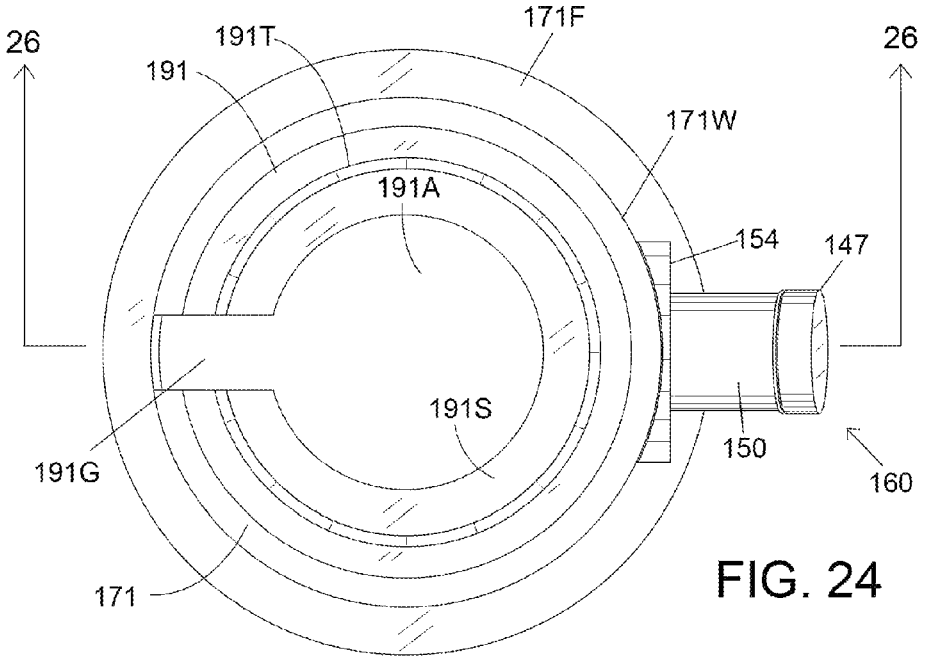
FIG. 24 is an orthogonal top view of the exemplary water bottle dispenser in accordance with one aspect of the present application.

Referring to FIG. 24 another top view of the dispenser may be seen. The front plate 154 of the retaining device 160 (FIGS. 20 and 21) may be clamped into position onto the sidewall. The top enclosure 191T, the center aperture 191A, the bottle seat 191S, and the side gap 191G of the bottle collar 191 may be seen. The threaded cylinder 150, the bottle cap 147, and the base foot 171F of the base 171 may also be seen.

Figure 25:
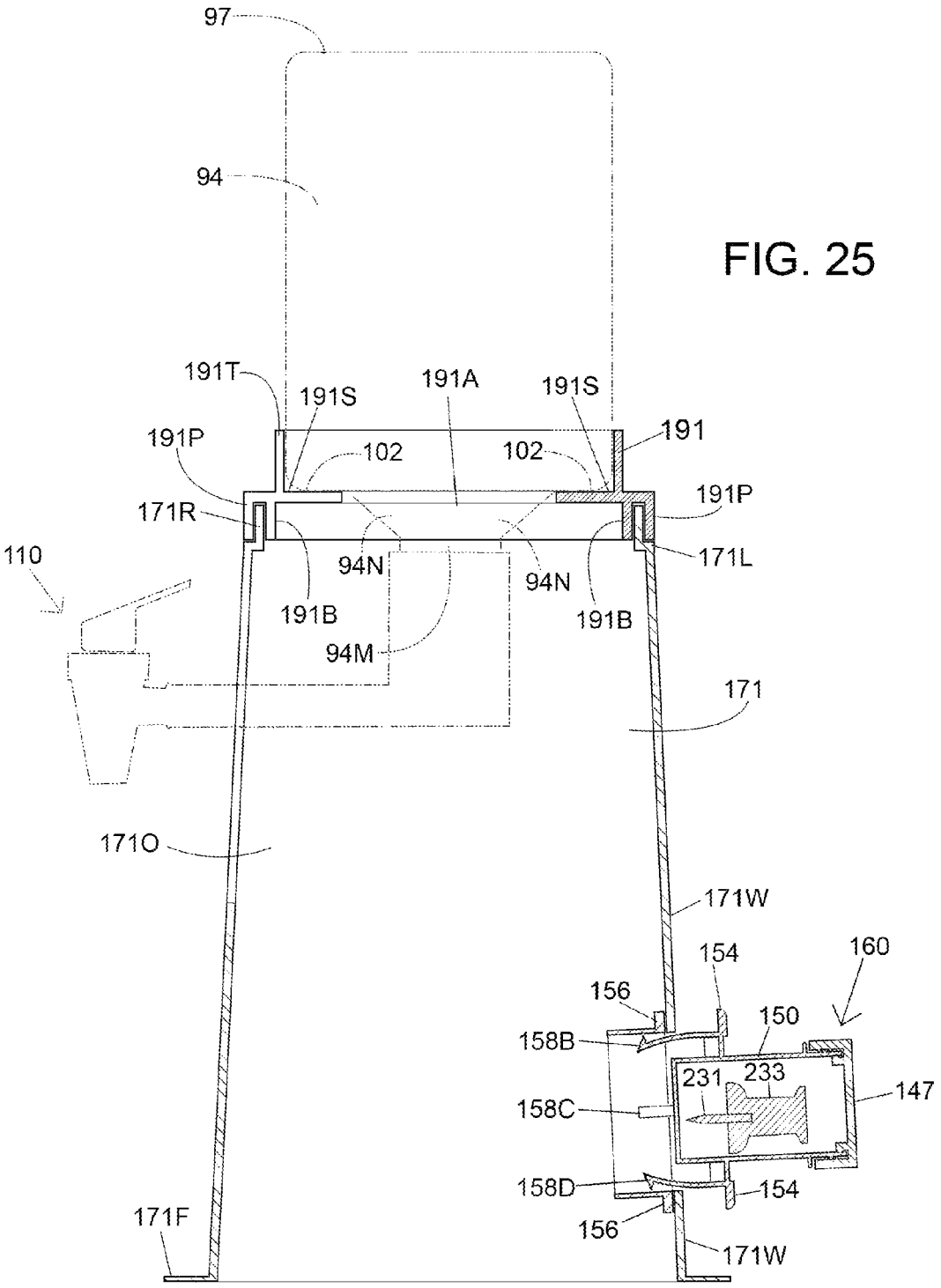
FIG. 25 is a sectional view of the exemplary water bottle dispenser of FIG. 23, taken at the sectioning plane in the direction indicated by section lines 25-25 in accordance with one aspect of the present application.
Figure 26:
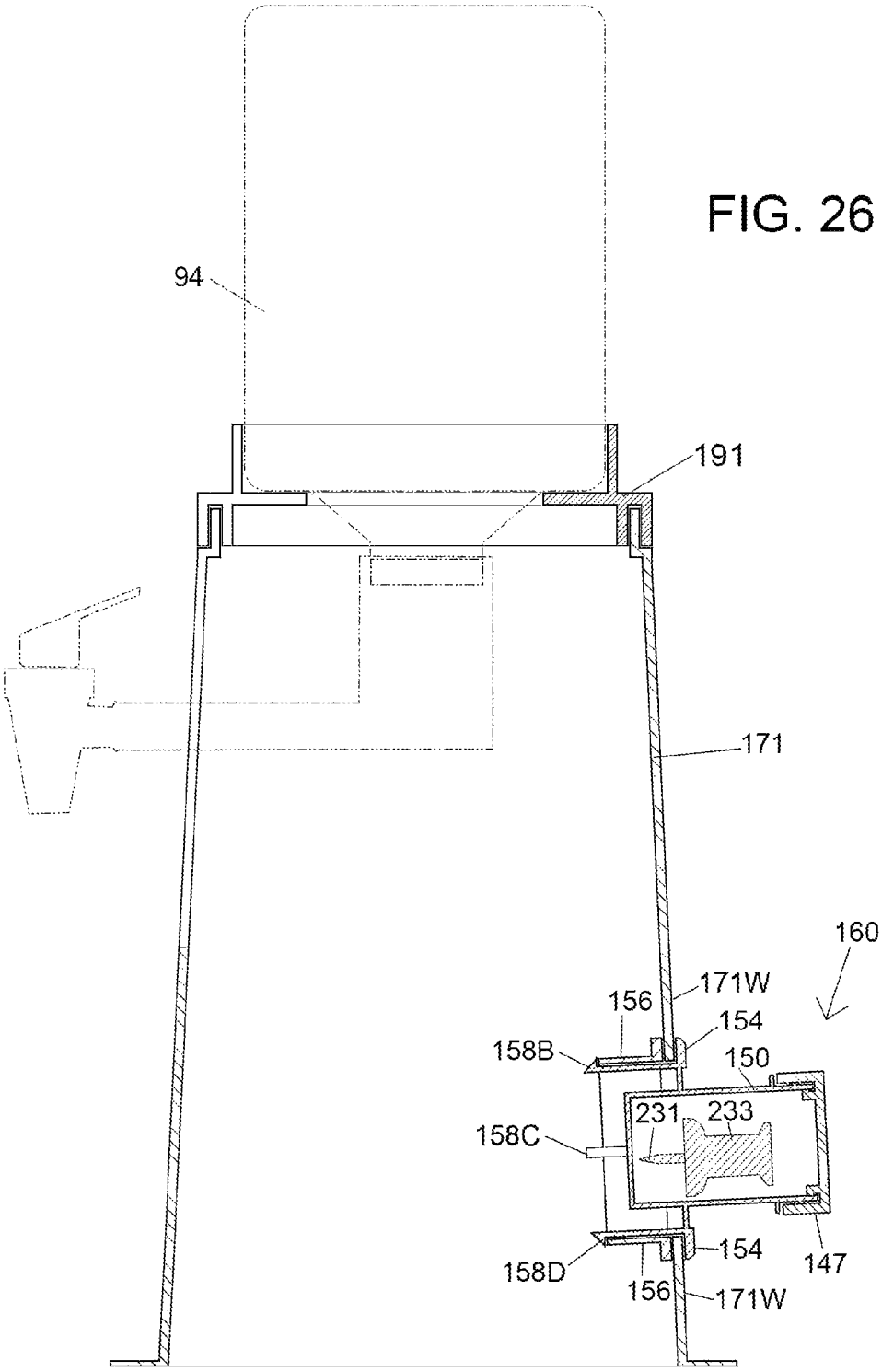
FIG. 26 is sectional view of the exemplary water bottle dispenser of FIG. 24, taken at the sectioning plane in the direction indicated by section lines 26-26 in accordance with one aspect of the present application.

Referring to FIG. 25, a sectional view taken at the sectioning plane in the direction indicated by section lines 25-25 of the dispenser of FIG. 23 may be seen. In the present embodiment, the bottle collar 191 may support the supply bottle 94. The rim 171R may be formed at a top portion of the base 171. The bottle collar 191 may be removably engaged upon the base ledge 171L of the base 171. The top enclosure 191T of the bottle collar 191 may be formed to engage the supply bottle 94. The top enclosure 191T may surround a portion of a sidewall 94S of the supply bottle 94. The top enclosure 191T of the bottle collar 191 may be formed to restrict a lateral movement of the supply bottle 94 inverted and positioned therein. The bottle seat 191S of the bottle collar 191 may merge with the top enclosure 191T. The bottle seat 191S may be formed to removably engage the supply bottle 94 on a shoulder 102 thereof. The bottle seat 191S may have the center aperture 191A where a neck 94N and the mouth 94M of the supply bottle 94 may extend there through when the supply bottle is inverted and positioned thereon. The peripheral portion 191P of the bottle collar 191 may merge with the bottle seat 191S and the top enclosure 191T of the bottle collar 191. The peripheral portion 191P of the bottle collar 191 may be formed to removably engage upon the base 171 at the base ledge 171L. The bottle collar 191 may be removably engaged upon base 171. The bottom ring 191B may merge with the peripheral portion 191P of the bottle collar 191. The bottom ring 191B may be positioned on the inside of the base rim 171R, and may be formed to restrict a lateral movement of the base the rim 171R within the peripheral portion 191P of the bottle collar 191. The front plate 154 of the retaining device 160 may be partially entered into the rear mounting plate 156 to illustrate the flexing of two of the four barbed fastening arms 158B and 158D of the front plate 154 prior to being locked into place as shown in FIG. 26. A $3^{rd}$ barbed fastening arm 158C may be flexed, and the $4^{th}$ barbed fastening arm 158A (FIGS. 20 and 21) may be flexed, but not illustrated as it may have been cut out of this FIG. 25 sectional view. All four barbed fastening arms 158A (referring to FIGS. 20 and 21), 158B, 158C and 158D may be part of the structure of the front plate 154. The piercing tool 233 may be used for administering the vent hole 97 in the supply bottle 94. The piercing tool 233 and the piercing tool spike 231 thereof may be located inside of the threaded cylinder 150 of the front plate 154. The bottle cap 147 from the supply bottle 94 may be threadably secured onto the threaded cylinder 150 of the front plate 154. The sidewall 171W of the base 171 may be positioned between the rear mounting plate 156 and the front plate 154. The dispenser valve 110 may be seen as extending through the side opening 171O to a location outside of the base 171 and the foot 171F may be formed at a bottom portion of base 171.

Referring to FIG. 26, a sectional view taken at the sectioning plane in the direction indicated by section lines 26-26 of the dispenser of FIG. 24 may be seen. The bottle collar 191 may be seen removably engaged upon the base 171. The bottle collar 191 may be adapted to engage and support the supply bottle 94 inverted and positioned within the bottle collar 191. The front plate 154 may be locked into position by four barbed fastening arms 158A of FIGS. 20 and 21, 158B, 158C, and 158D, into the rear mounting plate 156. While the present embodiment discloses four barbed fastening arms 158A of FIGS. 20 and 21, 158B, 158C, and 158D, this is for illustrative purposes only and differing numbers of barbed fastening arms may be used without departing from the spirit and scope of the present invention. The sidewall 171W of the base 171 may be positioned between the front plate 154 and the rear mounting plate 156. The sidewall 171W may support the front plate 154 and the rear mounting plate 156 of retaining device 160. The piercing tool 233 and the piercing tool spike 231 may be located inside of the threaded cylinder 150 of the front plate 154. The bottle cap 147 may be threaded into position onto the threaded cylinder 150 of the front plate 154.

Figure 27:
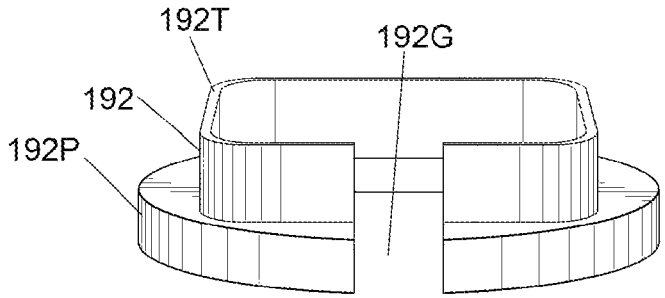
FIG. 27 is a perspective view of a bottle collar used with the exemplary water bottle dispenser in accordance with one aspect of the present application.

Referring to FIG. 27, a perspective view of the bottle collar 192 may be seen. A top enclosure 192T of the bottle collar 192 may be rounded rectangular in shape. However the top enclosure 192T may be formed in additional geometrical shapes and sizes to accommodate different shapes and sizes of additional supply bottles. A peripheral portion 192P of bottle collar 192 and the side gap 192G may be seen in the current embodiment.

Figure 28:
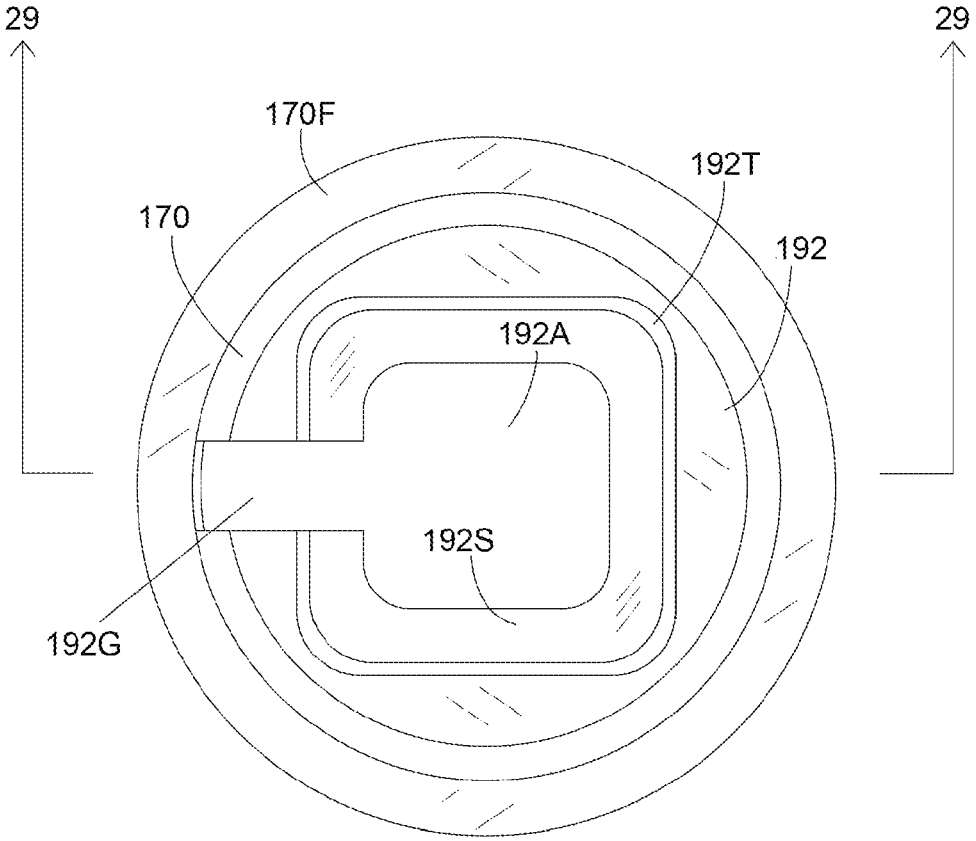
FIG. 28 is an orthogonal top view of the exemplary water bottle dispenser fitted with an exemplary bottle collar in accordance with one aspect of the present application.
Figure 29:
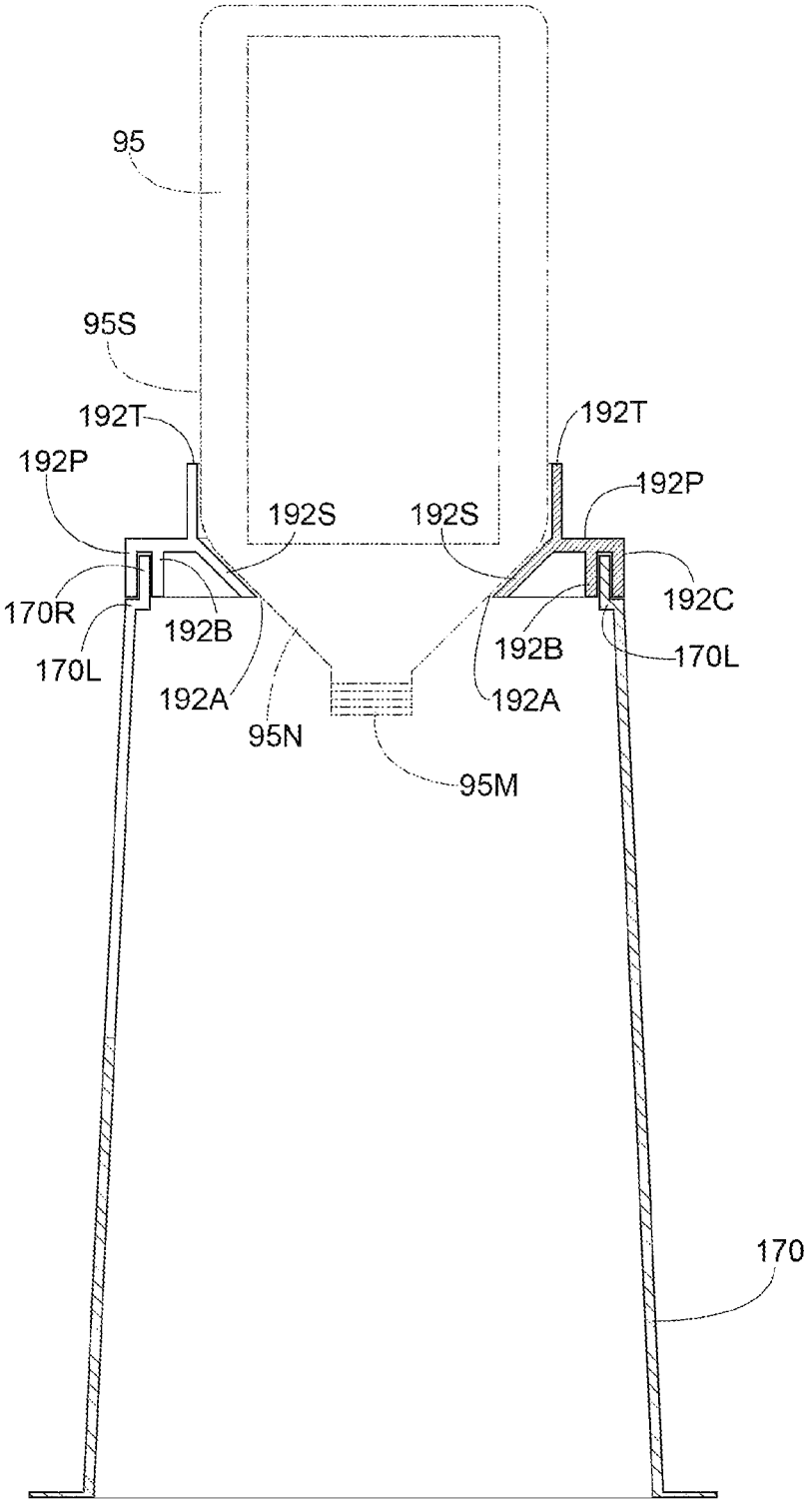
FIG. 29 is a sectional view of the exemplary water bottle dispenser of FIG. 28 taken at the sectioning plane in the direction indicated by section lines 29-29 in accordance with one aspect of the present application.

Referring to FIG. 28, a top view of the top enclosure 192T, a center aperture 192A, a bottle seat 192S, and the side gap 192G of the bottle collar 192 may be seen. The bottle collar 192 may be removably engaged upon the base 170. In the present embodiment, the base 170 may be cylindrical in shape. However, this is shown as one example and the base 170 may be formed into other geometrical shapes and sizes. The base 170 could be formed to be square, hexagonal, octagonal etc. and have square, hexagonal, octagonal, or other various types of cross sectional shapes. The base 170 may be configured for placement on a counter top or configured for placement on a floor. As shown in FIG. 29, the base 170 may be tapered. Thus, a bottom portion of the base 170 may be wider than an upper portion of the base 170. The tapered nature of the base 170 may provide added stability, and may allow for the base to be stacked. The base 170 may have a base foot 170F formed on a bottom portion thereof.

Referring to FIG. 29, a sectional view taken at the sectioning plane in the direction indicated by section lines 29-29 of FIG. 28 may be seen. The bottle collar 192 may be seen engaged with the base 170. The top enclosure 192T of the bottle collar 192 may be formed to engage the supply bottle 95. However, the supply bottle 95 may be formed in additional shapes and sizes that may be used with bottle collar 195. The top enclosure 192T may surround a portion of a sidewall 95S of the supply bottle 95. The top enclosure 192T may be formed to restrict lateral movement of the supply bottle 95 inverted and positioned therein. The bottle seat 192S may merge with the top enclosure 192T. The bottle seat 192S may be formed to removably engage the supply bottle 95 on a neck 95N thereof. The bottle seat 192S may have the center aperture 192A where the mouth 95M of the supply bottle 95 may extend there through into the base 170 when the supply bottle 95 may be inverted and positioned thereon. The peripheral portion 192P of the bottle collar 192 may merge with the bottle seat 192S and the top enclosure 192T of the bottle collar 192. The peripheral portion 192P of bottle collar 192 may be formed to removably engage upon a base ledge 170L of the base 170, thus the bottle collar 192 may be removably engaged upon the base 170. The bottom ring 192 may merge with the peripheral portion 192P of the bottle collar 192. The bottom ring 192B may be positioned on the inside of a rim 170R when the bottle collar 192 may be engaged to the base 170, and may be formed to restrict a lateral movement of the rim 170R.

Figure 30:
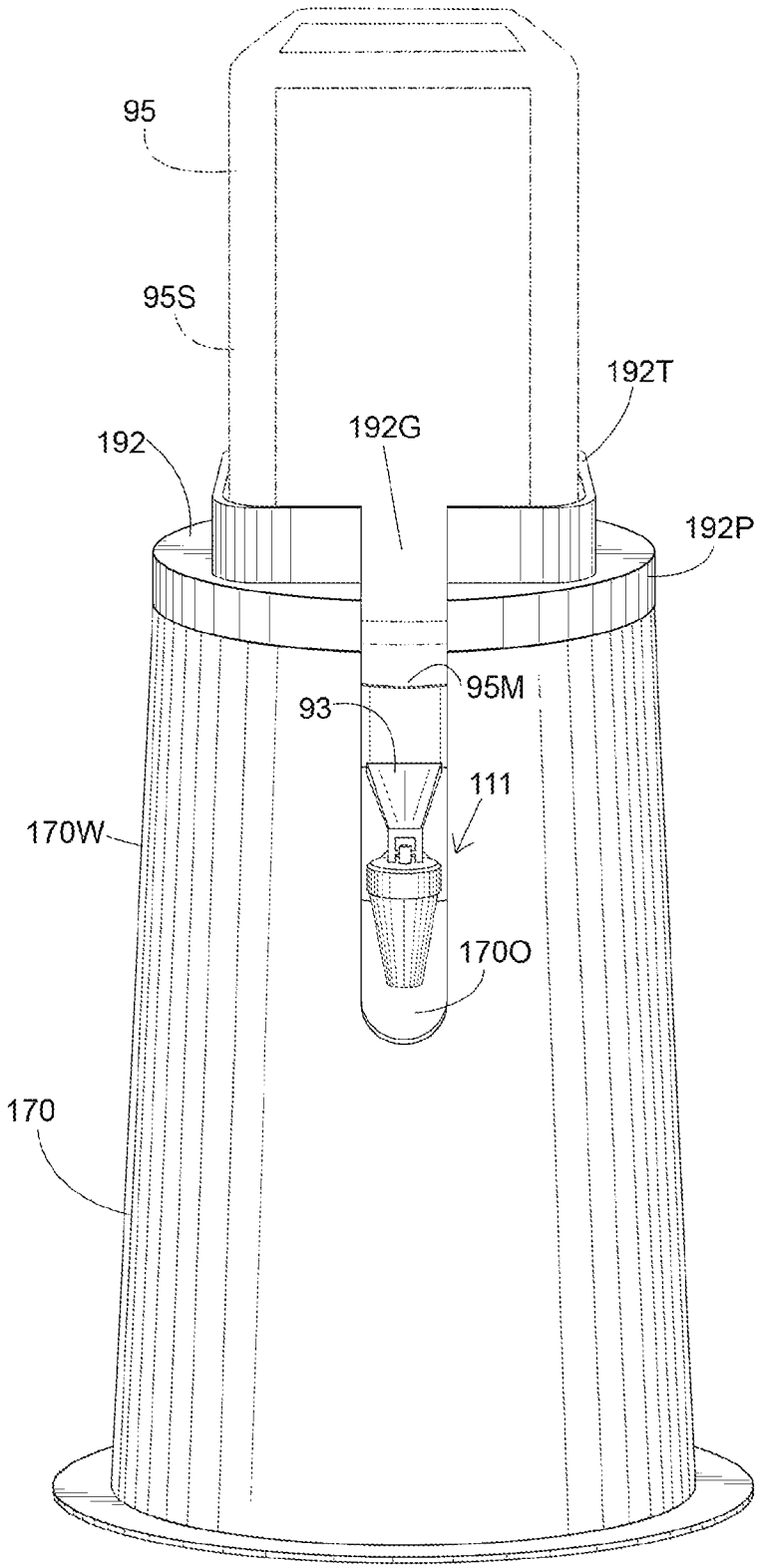
FIG. 30 is a perspective view of the front side of the exemplary water bottle dispenser in accordance with one aspect of the present application.

Referring to FIG. 30, a perspective front view of the dispenser may be seen. The bottle collar 192 may be seen removably engaged and support upon the base 170. The bottle collar 192 may be adapted to engage and support the supply bottle 95 while the supply bottle 95 may be inverted and positioned therein. A portion of the sidewall 95S of the supply bottle 95 may be surrounded by the top enclosure 192T. The peripheral portion 192P of bottle collar 192 may be removably engaged upon the base 170. The liquid (hereinafter water) from supply bottle 95 may be delivered from the mouth 95M of the supply bottle 95, through the side opening 170O formed in the sidewall 170W of base 170, and to a location outside of the base 170 when the valve activation lever 93 of dispenser valve 111 is activated.

Figure 31:
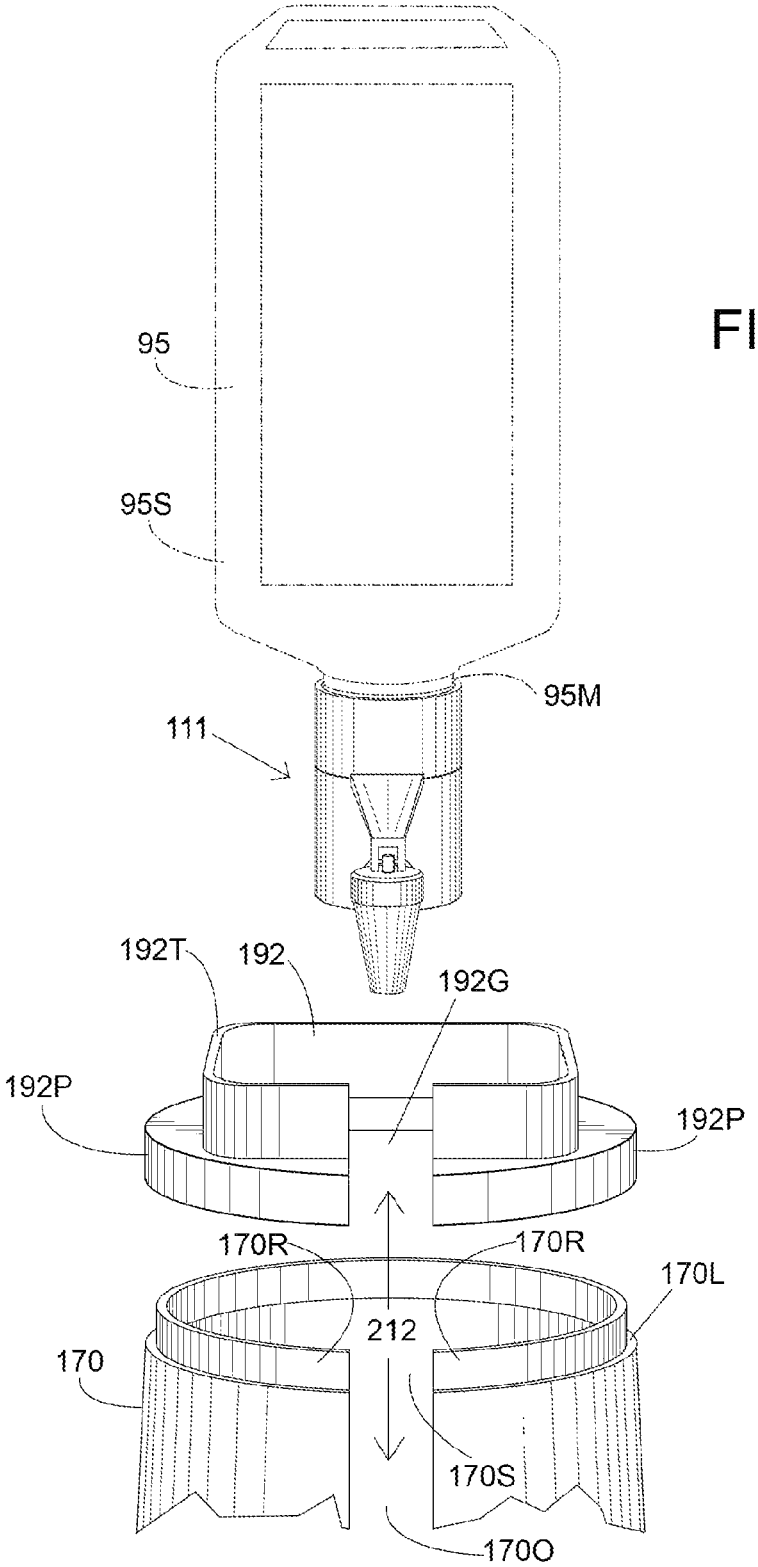
FIG. 31 is an exploded view of FIG. 30 in accordance with one aspect of the present application.

Referring to FIG. 31, an exploded view of FIG. 30 may be shown. The supply bottle 95 may be seen coupled to the dispenser valve 111. The bottle collar 192 may be seen separated from the dispenser base 170. The top enclosure 192T of the bottle collar 192 may surround and engage the supply bottle 95. The top enclosure 192T may prevent a sideward movement of the supply bottle 95 when the supply bottle 95 may be inverted and positioned into the bottle collar 192. The peripheral portion 192P may engage and support the bottle collar 192 upon the base ledge 170L of the base 170. The side opening 170O may extend upward through the open section 170S of the rim 170R. A valve passage 212 may be formed when the side gap 192G of the bottle collar 192 and the open section 170S of the rim 170R of the base 170 may align together when the bottle collar 192 may engage the base 170. The valve passage 212 may enable the valve 111 coupled to the supply bottle 95 to be lowered directly downward into the base 170 through the side gap 192G of the bottle collar 192 and the side opening 170O of the base 170.

Figure 32:
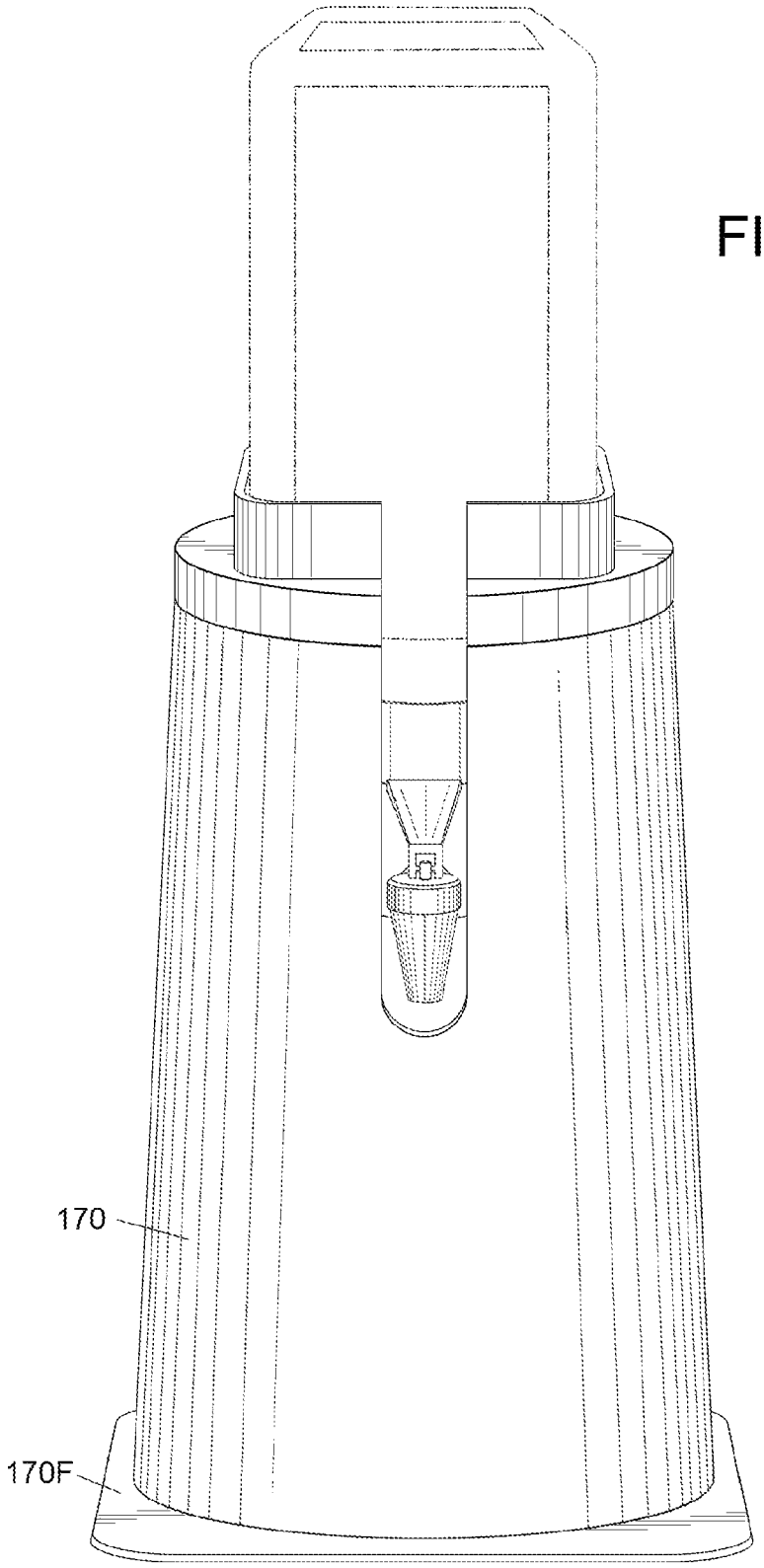
FIG. 32 is a perspective view of the front side of the exemplary water bottle dispenser in accordance with one aspect of the present application.

Referring to FIG. 32 the base foot 170F may be seen formed as a rounded rectangle base at the bottom of the base 170.

Figure 33:
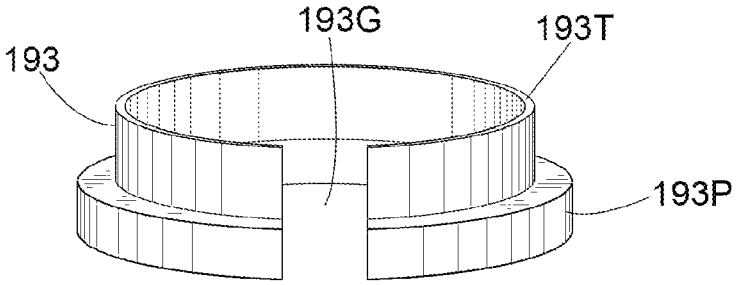
FIG. 33 is a perspective view of a bottle collar used with the exemplary water bottle dispenser in accordance with one aspect of the present application.

Referring to FIG. 33 a perspective view of a bottle collar 193 may be seen. The bottle collar 193 may be circular in shape, and may be similar to the bottle collar 191 of FIG. 25. However, the bottle collar 193 may have an angled bottle seat 193S as may be shown in FIG. 35 as opposed to the bottle seat 191S of the bottle collar 191 of FIG. 25 which may be flat. A top enclosure 193T of the bottle collar 193 may be circular in shape. The top enclosure 193T may be circular in shape however the top enclosure may be formed in additional geometrical shapes and sizes that accommodate different shapes and sizes of additional supply bottles. A peripheral portion 193P of the bottle collar 193 may be seen in the present embodiment.

Figure 34:
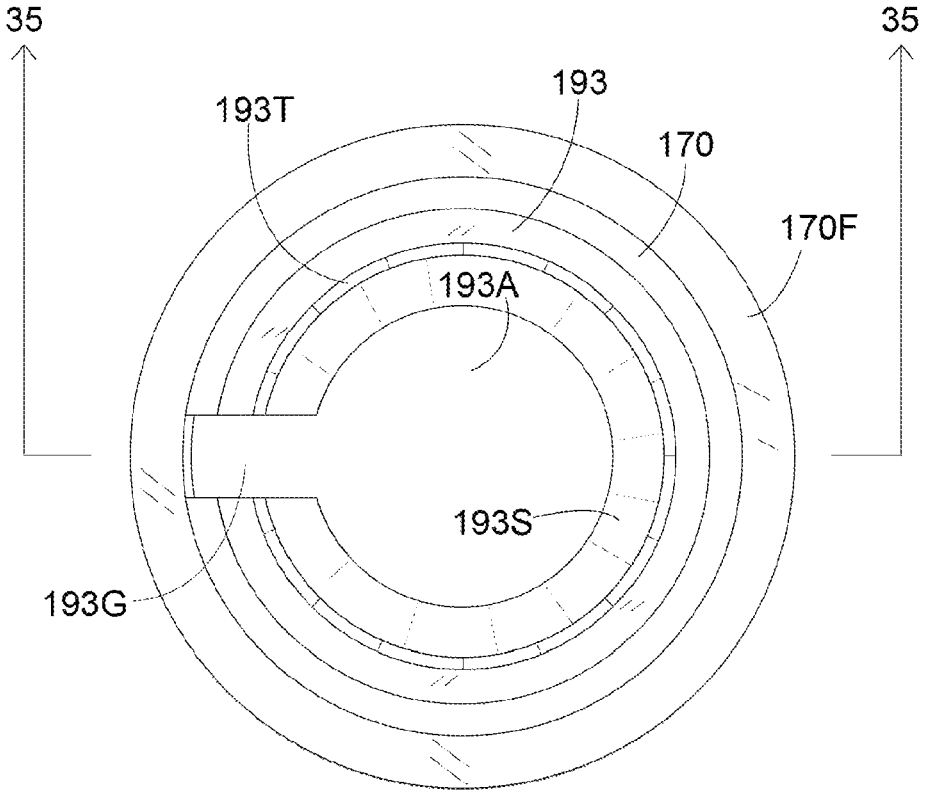
FIG. 34 is an orthogonal top view of the exemplary water bottle dispenser fitted with an exemplary bottle collar in accordance with one aspect of the present application.

Referring to FIG. 34 a top view of the bottle collar 193 may be illustrated. The top enclosure 193T, a center aperture 193A, and a bottle seat 193S of the bottle collar 193 may be seen. The bottle collar 193 may be seen removably engaged upon the base 170. The base 170 may have a the base foot formed on a bottom portion thereof. A bottle collar side gap 193G may be seen in the present embodiment.

Figure 35:
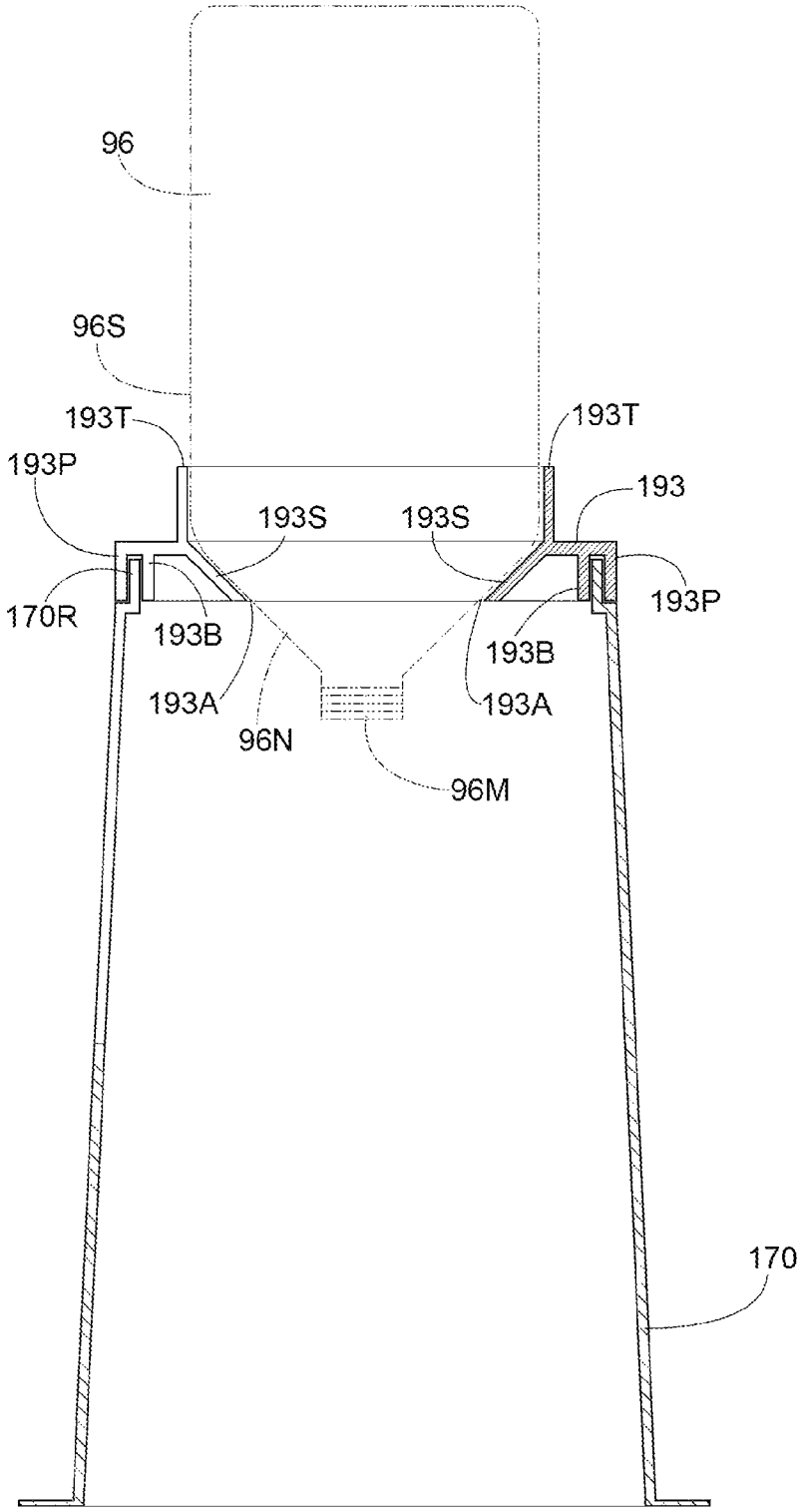
FIG. 35 is sectional view of the exemplary water bottle dispenser of FIG. 34, taken at the sectioning plane in the direction indicated by section lines 35-35 in accordance with one aspect of the present application.

Referring to FIG. 35, a sectional view taken at the sectioning plane in the direction indicated by section lines 35-35 of FIG. 34 may be seen. The bottle collar 193 may be seen engaged with the base 170. The top enclosure 193T of the bottle collar 193 may be formed to engage a supply bottle 96. The supply bottle 96 may be circular in shape, however the bottle collar 193 may accommodate other supply bottles of different shapes and sizes. The top enclosure 193T may surround a portion of a sidewall 96S of the supply bottle 96. The top enclosure 193T may be formed to restrict lateral movement of the supply bottle 96 inverted and positioned therein. The bottle seat 193S may merge with the top enclosure 193T. The bottle seat 193S may be formed to removably engage the supply bottle 96 on a neck 96N thereof. The bottle seat 193S may have the center aperture 193A where a mouth 96M of the supply bottle 96 may extend there through into the base 170 when the supply bottle 96 may be inverted and positioned thereon. The peripheral portion 193P of the bottle collar 193 may merge with the bottle seat 193S and the top enclosure 193T of the bottle collar 193. The peripheral portion 193P of bottle collar 193 may be removably engaged upon the base 170. The bottom ring 193B may merge with the peripheral portion 193P of the bottle collar 193. The bottom ring 193B may be positioned on the inside of the rim 170R when the bottle collar 193 may be engaged with the base 170, and may be formed to restrict a lateral movement of the rim 170R.

Figure 36:
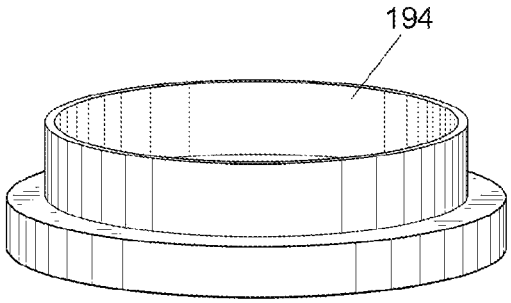
FIG. 36 is a perspective view of an alternative bottle collar used with the exemplary water bottle dispenser in accordance with one aspect of the present application.

Referring to FIG. 36 an alternate version of the bottle collar 191, a bottle collar 194 may be shown. The bottle collar 194 may be void of the side gap 191G that the bottle collar 191 of FIG. 16 may have.

Figure 37:
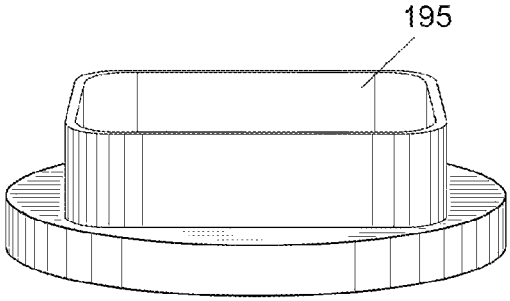
FIG. 37 is a perspective view of an alternative bottle collar used with the exemplary water bottle dispenser in accordance with one aspect of the present application.

Referring to FIG. 37 an alternate version of the bottle collar 192, a bottle collar 195 may be shown. The bottle collar 195 may be void of the side gap 192G that the bottle collar 192 of FIG. 27 may have.

Figure 38:
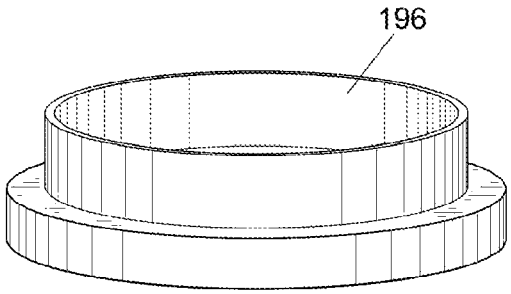
FIG. 38 is a perspective view of an alternative bottle collar used with the exemplary water bottle dispenser in accordance with one aspect of the present application.

Referring to FIG. 38 an alternate version of the bottle collar 193, a bottle collar 196 may be shown. The bottle collar 196 may be void of the side gap 193G that the bottle collar 193 of FIG. 33 may have.

Figure 39:
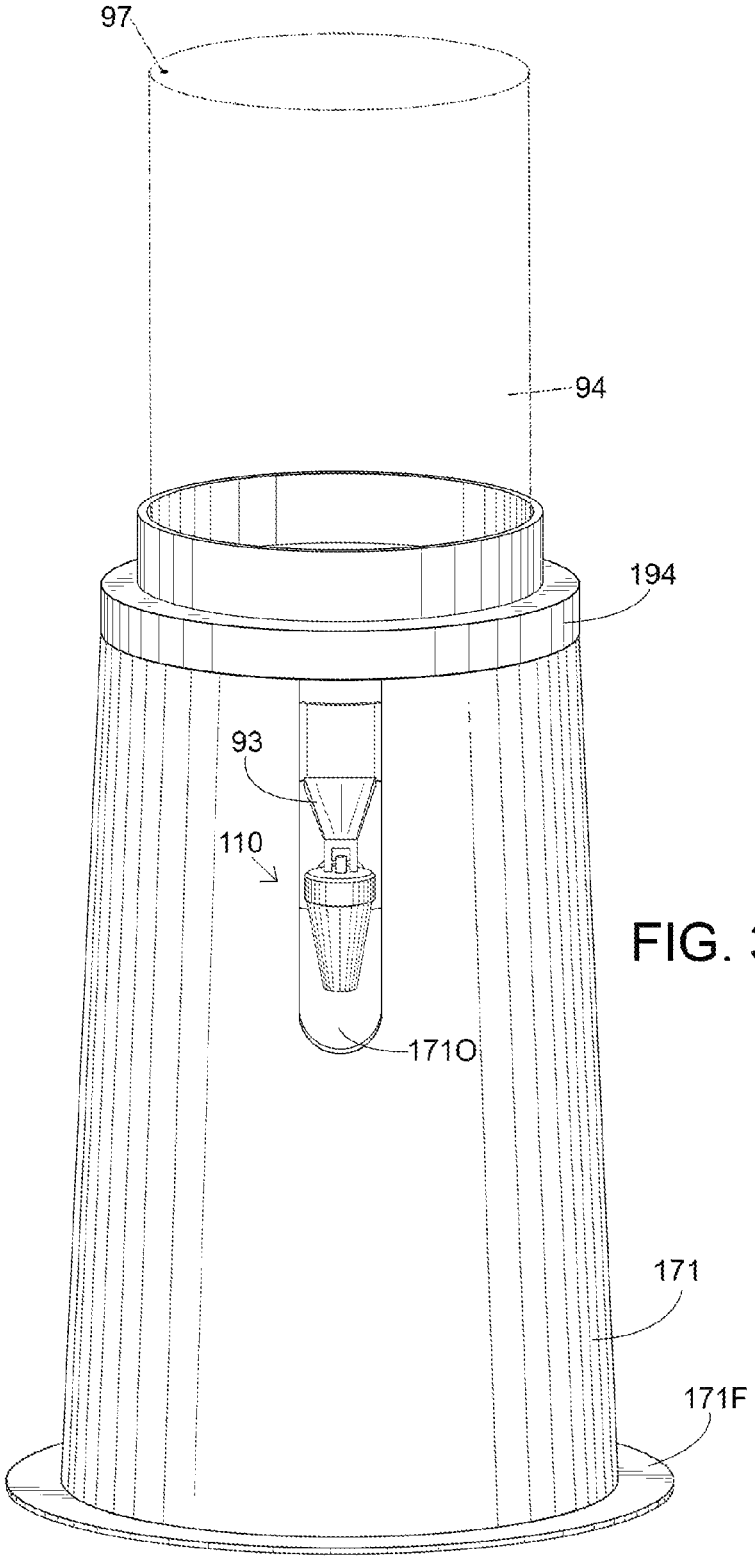
FIG. 39 is a perspective front view of an alternative dispenser in accordance with one aspect of the present application.

Referring to FIG. 39, the dispenser with the alternate bottle collar 194 may be seen removably engaged upon the base 171. The supply bottle 94 may be seen inserted into the bottle collar 194 and the valve 110 may be coupled to the supply bottle 94. The valve 110 may be extending through the side opening 171O. The valve activation lever 93 of the valve 110 may be shown.

Figure 40:
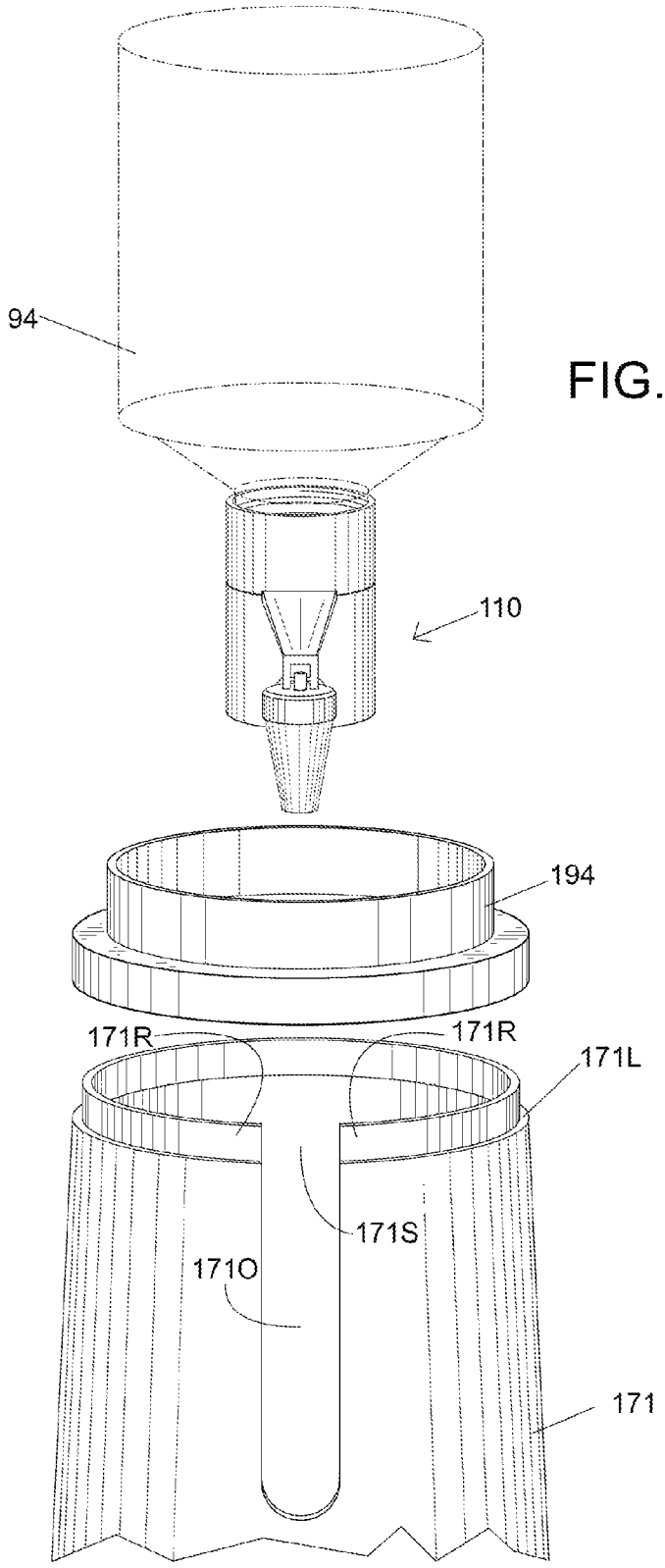
FIG. 40 is an exploded view of FIG. 39 in accordance with one aspect of the present application.

Referring to FIG. 40 an exploded view of the dispenser with the alternative bottle collar 194 of FIG. 39 may be seen. The valve 110 may be seen coupled to the supply bottle 94. The alternate bottle collar 194 may be seen separated from a broken view of the base 171. The base ledge 171L may be where the alternative bottle collar 194 may removably engage upon the base 171. The side opening 171O may be shown extending through the base rim 171R.

Figure 41:
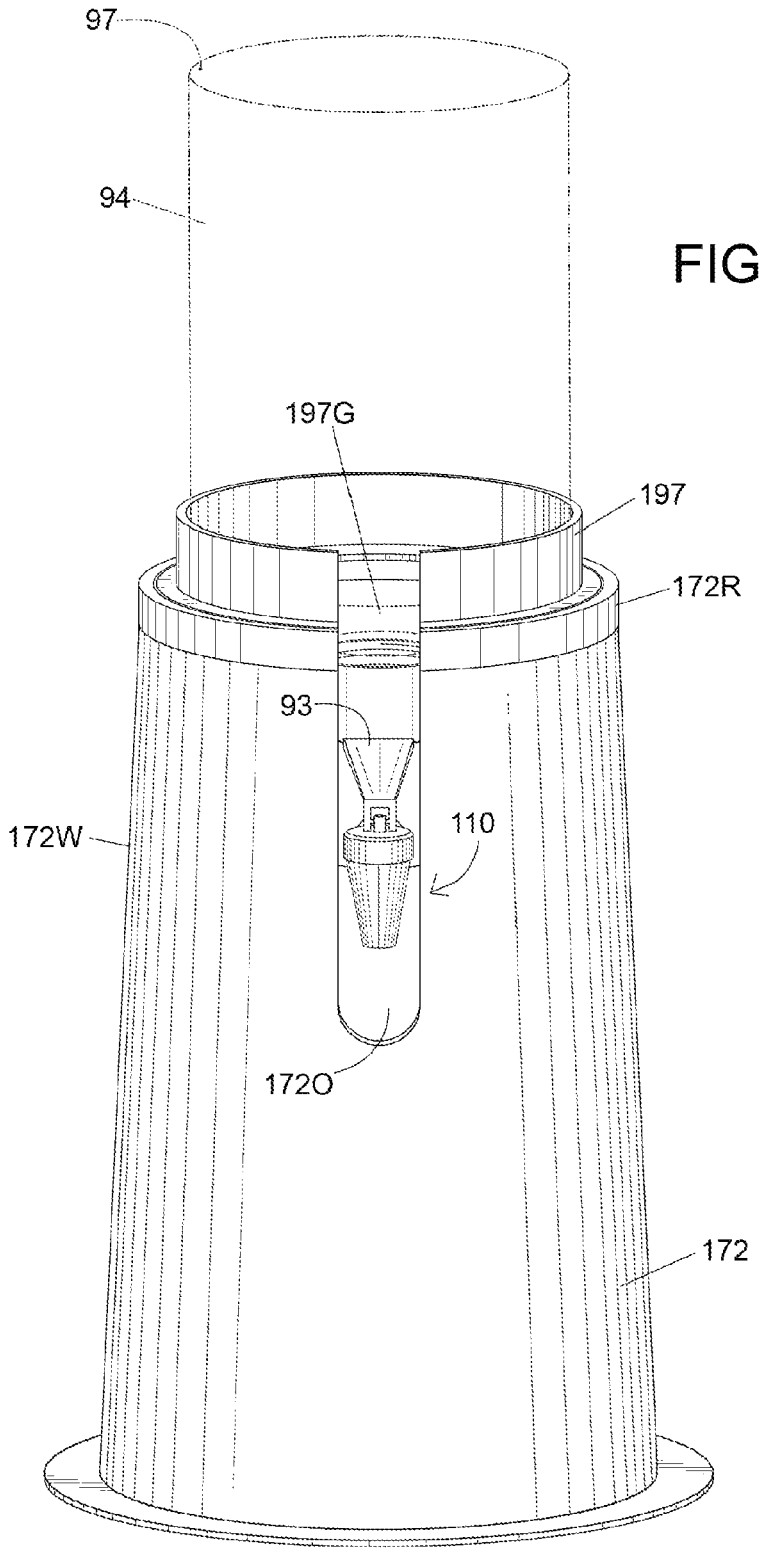
FIG. 41 is a perspective front view of an alternative water bottle dispenser in accordance with one aspect of the present application.

Referring to FIG. 41 an alternative dispenser may be seen. An alternative bottle collar 197 may be shown removably engaged within a rim 172R of an alternative walled dispenser base 172 (hereinafter alternative base 172). The alternative base 172 may have a side opening 172O that may be formed in a sidewall 172W of the alternative base 172. The dispenser valve 110 may be seen extending out of the side opening 172O. A side gap 197G in the bottle collar 197 may merge with the side opening 172O of the alternative base 172 and form a valve passage 213 of FIG. 42.

Figure 42:
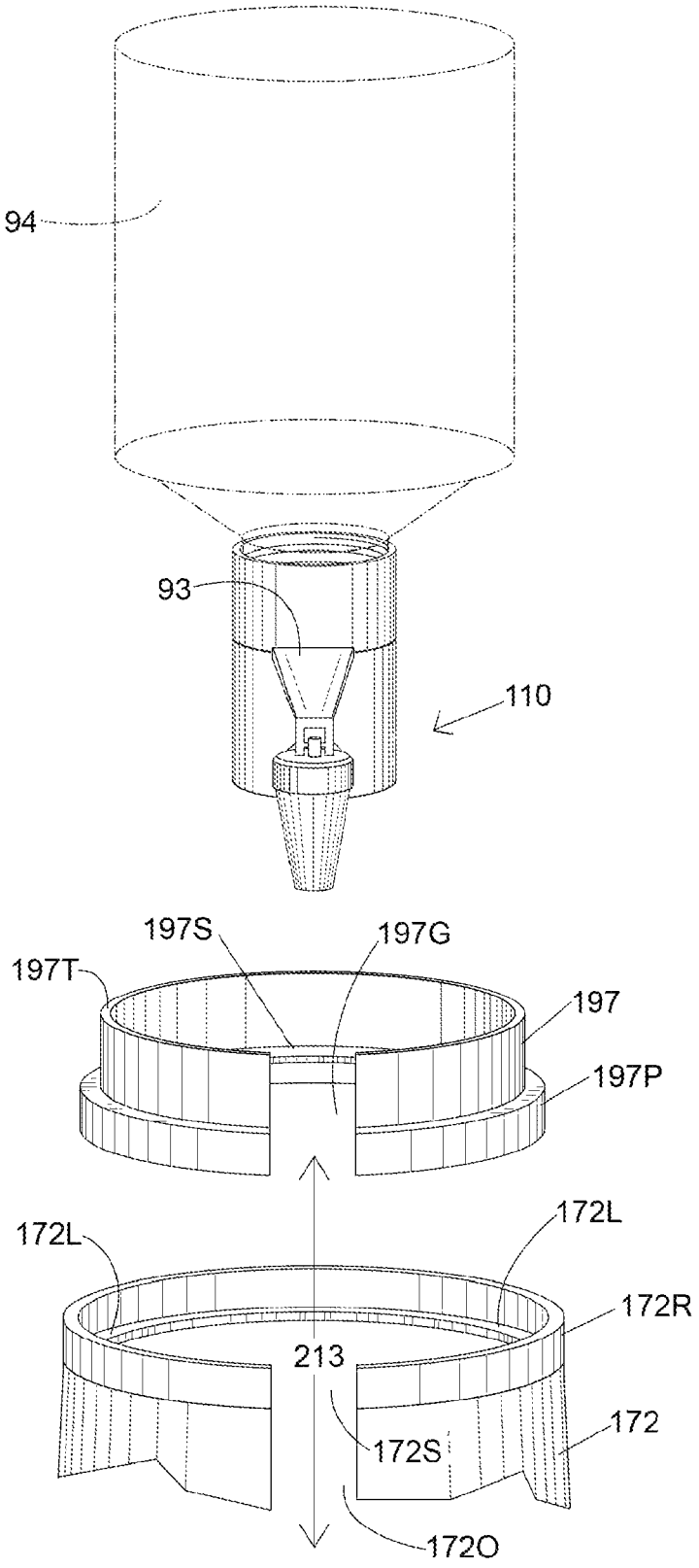
FIG. 42 is an exploded view of FIG. 41 in accordance with one aspect of the present application.

Referring to FIG. 42, an exploded view of the alternative dispenser of FIG. 41 may be seen. The alternative bottle collar 197 may be shown separated from the alternative base 172. The alternative base 172 may have a ledge 172L formed in the interior of the alternative base 172 wherein a peripheral portion 197P of the alternative bottle collar 197 removably engages with the base ledge 172L of the alternative base 172. The side opening 172O may extend upward through an open section 172S of the rim 172R. A valve passage 213 may be formed when the side gap 197G of the alternative bottle collar 197 and the open section 172S of the rim 172R of the alternative base 172 may align together when the bottle collar 197 may engage the alternative base 172. The valve passage 213 may enable the valve 110 coupled to the supply bottle 94 to be lowered directly downward into the alternative base 172 through the side gap 197G of the bottle collar 197 and the side opening 172O of the alternative base 172. Additionally, a variety of bottle collars beyond the bottle collar 197 that fit different inverted bottles and use the alternative base 172 could be created.

Figure 43:
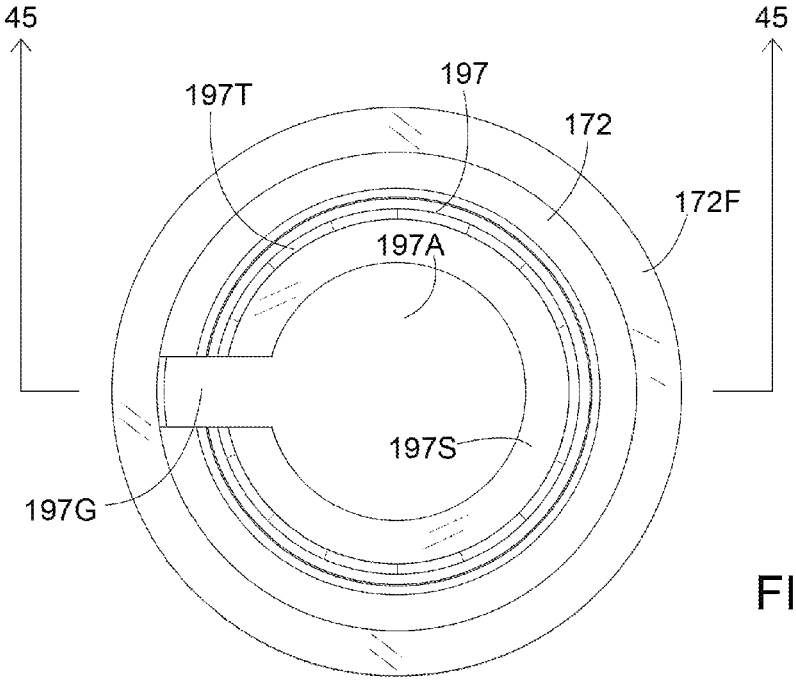
FIG. 43 is an orthogonal top view of an alternative water bottle dispenser in accordance with one aspect of the present application.

Referring to FIG. 43, an orthogonal top view of the alternative dispenser of FIG. 41 may be seen. The top enclosure 197T, a center aperture 197A, the bottle seat 197S, and the bottle collar side gap 197G of the bottle collar 197 may be seen in the present embodiment. The base foot 172F of the alternative base 172 may also be seen Referring to FIG. 44, an orthogonal top view of an alternative dispenser may be seen. A top enclosure 198T, a center aperture 198A, a bottle seat 198S, and a bottle collar side gap 198G of an alternative bottle collar 198 may be seen. An alternative dispenser base 174 and a base foot 174F may be seen.

Figure 45:
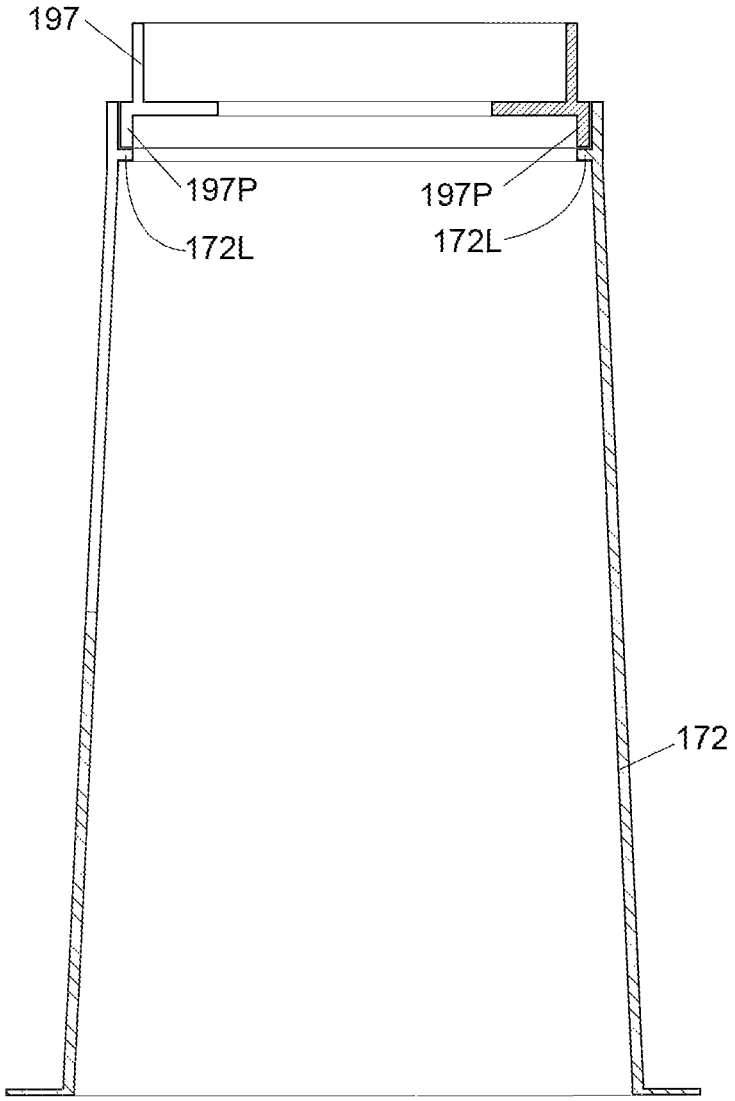
FIG. 45 is a sectional view of an alternative water bottle dispenser of FIG. 43, taken at the sectioning plane in the direction indicated by section lines 45-45 in accordance with one aspect of the present application.

Referring to FIG. 45, a sectional view taken at the sectioning plane in the direction indicated by section lines 45-45 of the alternative dispenser of FIG. 43 may be seen. In the sectional view of FIG. 45, the peripheral portion 197P of the alternative bottle collar 197 may be removably engaged upon the interior ledge 172L of the alternative base 172. The interior ledge 172L of the alternative base 172 may support the alternative bottle collar 197.

Figure 46:
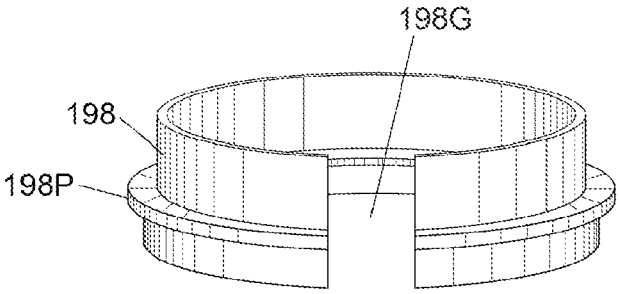
FIG. 46 is a perspective view of an alternative bottle collar used with an alternative water bottle dispenser in accordance with one aspect of the present application.

Referring to FIG. 46, a perspective view of the alternative bottle collar 198 may be seen. The bottle collar side gap 198G and a peripheral portion 198P of the bottle alternative collar 198 may be seen in the present embodiment.

Figure 44:
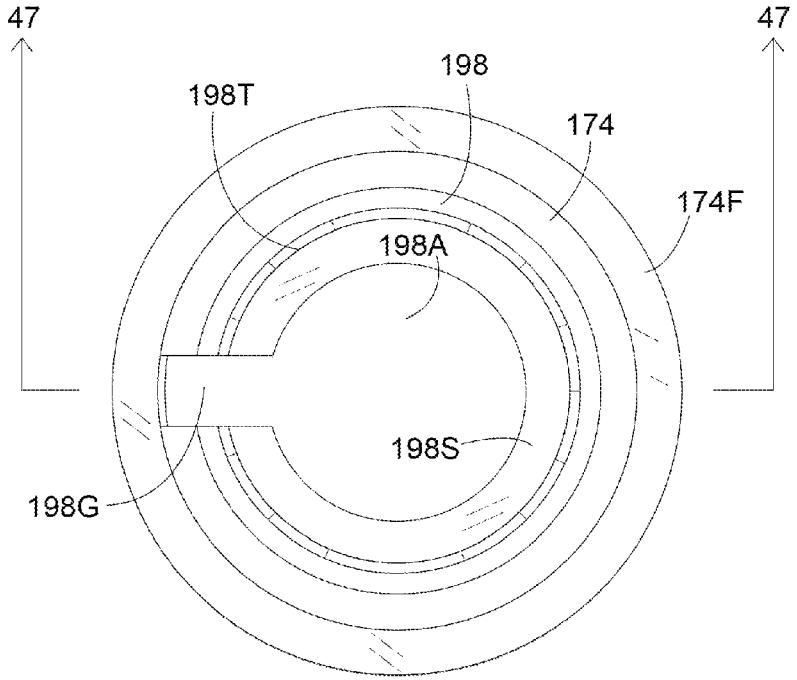
FIG. 44 is an orthogonal top view of an alternative water bottle dispenser in accordance with one aspect of the present application.
Figure 47:
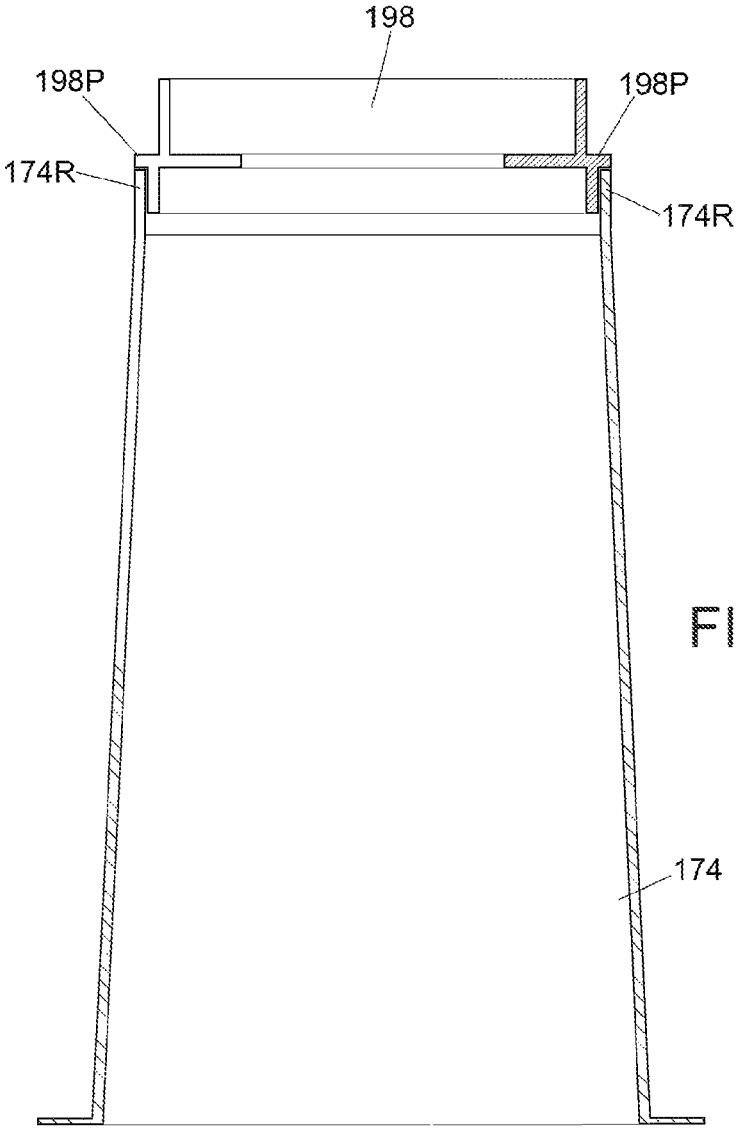
FIG. 47 is sectional view of an alternative water bottle dispenser of FIG. 44, taken at the sectioning plane in the direction indicated by section lines 47-47 in accordance with one aspect of the present application.

Referring to FIG. 47, a sectional view taken at the sectioning plane in the direction indicated be section lines 47-47 of the alternative dispenser of FIG. 44 may be seen. In the sectional view of FIG. 47 the peripheral portion 198P of the alternative bottle collar 198 may be removably engaged upon a base rim 174R of the alternative dispenser base 174. The base rim 174R of the alternative dispenser base 174 may engage and support the alternative bottle collar 198.

Referring to FIGS. 16,18,19,21 and 26 operation and use of the dispenser may be described. To begin with, the base 171 of the dispenser of FIG. 16 may be placed on its side onto a countertop or desktop. The rear mounting plate 156 of FIG. 21 may be placed in the inside of the base 171 and pressed up against the retaining device void 171V of FIG. 19. The front plate 154 of FIG. 21 may be inserted through the sidewall 171W and into the rear mounting plate 156 until all four barbed fastening arms 158A, 158B, 158C, and 158D of the front plate 154 are locked into position against the rear mounting plate 156 referring to FIG. 26. The base 171 may then be placed in an upright position onto a countertop, desktop, floor or other dispensing surface. The bottle collar 191 may be placed into position upon the base ledge 171L of base 171 of FIG. 16 making sure that the side gap 191G of the bottle collar 191 is in alignment with the side opening 171O of the base 171.

The dispenser valve 110 may be installed onto an upright supply bottle 94 (upright position of supply bottle 94 not shown) of FIG. 18, and then the dispenser valve 110 coupled to the supply bottle 94 may be inverted and lowered directly downward into the valve passage 211 until the supply bottle 94 is engaged within the top enclosure 191T the bottle collar 191 FIG. 17. At this point, the piercing tool spike 231 of the piercing tool 233 of FIG. 21 may be used to puncture a portion of the supply bottle 94 forming the vent hole 97 of FIG. 17. The vent hole 97 may vent the supply bottle 94 to atmosphere. When the vent hole 97 is administered, the piercing tool 233 may be placed inside the threaded cylinder 150 of the retaining device 160 of FIG. 21, and the bottle cap 147 may be threadably secured onto the threaded cylinder 150. The supply bottle 94 may now dispense and serve water and valve activation lever 93 may be activated. It should be noted that if the dispenser valve 111 were to be used in place of dispenser valve 110, the vent hole 97 might not be needed.

Referring to FIGS. 30 and 31, operation of the dispenser with the base 170 having no piercing tool may be disclosed. To begin with, the base 170 of the dispenser of FIG. 30 may be placed in an upright position onto a countertop, desktop, floor or other dispensing surface. The bottle collar 192 may be placed upon the base ledge 170L of base 170 as in shown in FIG. 31 making sure that the side gap 192G of the bottle collar 192 is in alignment with the side opening 170O of the base 170. The dispenser valve 111 may be installed onto an upright supply bottle 95 (upright position of supply bottle 95 not shown). The dispenser valve 111 coupled to the supply bottle 95 may be inverted and lowered directly downward into the valve passage 212 until the supply bottle 95 is engaged within the top enclosure 192T of the bottle collar 192. The supply bottle 95 may be used to serve and dispense water by activating valve activation lever 93 of dispenser valve 111.

Referring to FIGS. 41 and 42, operation of the alternative dispenser of FIG. 41 with the alternative base 172 having no piercing tool may be disclosed. To begin with, the alternative base 172 of the dispenser of FIG. 41 may be placed in an upright position onto a countertop, desktop, floor or other dispensing surface. The bottle collar 197 may be inserted within the base rim 172R and placed upon the base ledge 172L of alternative base 172 as in shown in FIG. 42 making sure that the side gap 197G of the bottle collar 197 is in alignment with the open section 172S of the rim 172R of the alternative base 172. The dispenser valve 110 may be installed onto an upright supply bottle 94 (upright position of supply bottle 94 not shown). The dispenser valve 110 coupled to the supply bottle 94 may be inverted and lowered directly downward into the valve passage 213 until the supply bottle 94 is engaged within the top enclosure 197T of the bottle collar 197. The supply bottle 94 may be used to serve and dispense water by activating valve activation lever 93 of dispenser valve 110 once the vent hole 97 has been administered to the supply bottle 97.

The dispenser of the present invention may provide numerous advantages. The dispenser may accommodate a variety of commercial water bottles that currently have no additional dispensing methods other than the pouring of the water directly from the bottle mouth of the bottle. The dispenser may provide a dispenser valve 110 and/or a dispenser valve 111. The dispenser may use the dispenser valve 110 that has a reservoir. The reservoir may be provided to store water transferred from the supply bottle. The water transferred from the supply bottle to the reservoir in the dispenser valve 110 may cause the water level in the supply bottle to drop to a predetermined level. The dropped water level in the supply bottle may allow for a vent hole to be administered in the supply bottle without water escaping from the vent hole. Alternatively, the dispenser valve 111 may be provided that may allow for the supply bottle to be set upright and placed in a refrigerator, wherein a venting hole may not be needed in the supply bottle.

The dispenser valves 110 and 111 may be quickly installed onto different types of bottles. Once the dispenser valve 110 or dispenser valve 111 is installed, the water bottle may be quickly inserted into the base 170 or the base 171. The dispenser bases 170 and 171 may have a side opening formed in a sidewall of the dispenser base that extends through an open section of a rim of the dispenser base which may make it possible for a dispenser valve when coupled to a supply bottle to be lowered directly downward into the dispenser base. The dispenser bases 170 and 171 may have a bottle collar that has a side gap. When aligned with the open section of the rim of the dispenser base the side gap of the bottle collar may form a valve passage. The valve passage may enable the dispenser valves 110 and 111 coupled to a supply bottle to be lowered directly downward into the dispenser bases 170 and 171. A retaining device 160 may be attached to the dispenser base. The retaining device may have a threaded cylinder 150 that may store a piercing tool 233. The piercing tool 233 may be readily available to vent the supply bottle used with base 171. The bottle cap of the inverted supply bottle may be threadably attached to the threaded cylinder 150 of the retaining device 160. The retaining device 160 may help prevent the bottle cap from becoming lost.

The dispenser generally requires no cleaning as water is dispensed directly from the single use water bottles. Spillage of water is generally unlikely from the mouth of the water bottle as the dispenser valve 110 and/or dispenser valve 111 may be installed prior to lifting of the water bottle, so the bottle wall generally will not push in and force water out of the mouth of the water bottle. Further water contamination of the bottled water is unlikely as the water is received through the dispenser valve 110 and/or dispenser valve 111. The dispenser may allow for fewer quantities of the 4 oz. to 24 oz. water bottles to be used as the dispenser may allow for more "gallon" or larger jugs to be used in households and may lead to an improvement in the environment.

While embodiments of the disclosure have been described in terms of various specific embodiments, those skilled in the art will recognize that the embodiments of the disclosure may be practiced with modifications within the spirit and scope of the claims. For example, other embodiments of valves/connectors may be used to dispense water from the water bottle. Different embodiments of piercing tools as well as different embodiments of mounting devices for the piercing tools may be used. Also, the dispenser base and the bottle collar could take on additional geometrical shapes/sizes other than the shape of the dispenser bases and bottle collars addressed in the above description. Furthermore, the dispenser could be used with inverted beverage bottles in addition to inverted water bottles. Accordingly, the scope should be determined not by the specific embodiments illustrated, but by the appended claims and their legal equivalents.

DRAWINGS

Reference Numbers

70—removable dispenser valve
77—valve body outlet port
78—component compartment
78T—component compartment top
81—reservoir
82—threaded inlet port top
83—valve body inlet port
84—vent tube
84A—vent tube inlet port
84B—barbed vent tube port
85—seat cup
85W—seat cup wall
87—sealing seat
89—peg
89B—peg base
89S—spring base
89R—right pin slot
89L—left pin slot
90—coiled spring
91—component compartment bonnet
92—peg aperture
93—valve activation lever
93R—valve activation lever right pin
93L—valve activation lever left pin
94—supply bottle
94M—bottle mouth
94N—bottleneck
94S—bottle sidewall
95—supply bottle
95M—bottle mouth
95N—bottle neck
95S—bottle sidewall
96—supply bottle
96M—bottle mouth
96N—bottleneck
96S—bottle sidewall
97—vent hole
98—liquid level
99B—bottom tube
99T—top tube
100—check valve
100T—top barbed outlet
100B—bottom barbed inlet
101—tube outlet
102—bottle shoulder
103—bottle union
103T—union
103B—union bottom
105—bottle union
105T—union top
105B—union bottom
107—bottle union
107T—union top
107B—union bottom
109—alternative bottle union
109T—alternative bottle union top
109B—alternative bottle union bottom
110—reservoir dispenser valve assembly. Reservoir dispenser valve assembly 110 includes the following parts: valve body 110B, seat cup 85, peg 86, coil spring 90, component compartment bonnet 91, valve activation lever 93, bottle union 103
110B—valve body
111—vented dispenser valve assembly. Vented dispenser assembly 111 includes the following parts: valve body 111B, seat cup 85, peg 86, coil spring 90, component compartment bonnet 91, valve activation lever 93, bottle union 103
111B—valve body
147—bottle cap
150—threaded cylinder
154—front plate
156—rear mounting plate
158A—barbed fastening arm
158B—barbed fastening arm
158C—barbed fastening arm
158D—barbed fastening arm
160—retaining device assembly (used with base 171 of the dispenser) Retaining device assembly 160 includes the following parts: front plate 154, rear mounting plate 156, piercing tool 233, and bottle cap 147
170—base
170F—base foot
170L—base ledge
170O—base side opening
170R—base rim
170S—rim open section
170W—dispenser base sidewall
171—dispenser base (including retaining device void 171V)

171V—retaining device void
171F—base foot
171L—base ledge
171O—base side opening
171R—base rim
171S—rim open section
171W—dispenser base sidewall
172—base (valve opening 172O only)
172L—interior base ledge
172S—rim open section
172W—dispenser base sidewall
174—alternative base
174R—base rim
191—removable bottle collar
191A—bottle collar center aperture
191P—bottle collar peripheral portion
191G—bottle collar side gap
191S—bottle collar bottle seat
191T—bottle collar top enclosure
192—removable bottle collar
192A—bottle collar center aperture
192P—bottle collar peripheral portion
192G—bottle collar side gap
192S—bottle collar bottle seat
192T—bottle collar top enclosure
193—removable bottle collar
193A—bottle collar center aperture
193P—bottle collar peripheral portion
193G—bottle collar side gap
193S—bottle seat
193T—top enclosure
194—alternative removable bottle collar
195—alternative removable bottle collar
196—alternative removable bottle collar
197—alternative removable bottle collar
197A—bottle collar center aperture
197P—bottle collar peripheral portion
197G—bottle collar side gap
197S—bottle seat
197T—top enclosure
198—alternative removable bottle collar
198A—bottle collar center aperture
198P—bottle collar peripheral portion
198G—bottle collar side gap
198S—bottle seat
198T—top enclosure
211—valve passage
212—valve passage
213—valve passage
231—piercing tool spike
233—piercing tool

I claim:

1. A walled dispenser base for use with a dispenser for delivering a liquid from an inverted supply bottle comprising:

a top portion whereon the inverted supply bottle is supported;

a rim;

a side opening formed in a side of the walled dispenser base;

a foot formed at a bottom portion of the walled dispenser base; and a retaining device attached to the walled dispenser base for supporting and securing a piercing tool thereto, wherein the piercing tool is used to administer a vent hole in the inverted supply bottle.

2. The walled dispenser base of claim 1 comprising a bottle collar engaging the top portion of the walled dispenser base, the bottle collar adapted to engage the inverted supply bottle positioned thereon, the bottle collar having a center aperture in a bottle seat where a mouth of the inverted supply bottle extends there through, the liquid from the inverted supply bottle being delivered from a dispenser valve coupled to the mouth of the inverted supply bottle.

3. The walled dispenser base of claim 1 comprising:

a bottle collar engaging the top portion of the walled dispenser base, the bottle collar adapted to engage the inverted supply bottle positioned thereon, the bottle collar having a center aperture in a bottle seat where a mouth of the inverted supply bottle extends there through; and a dispenser valve coupled to the mouth of the inverted supply bottle, the dispenser valve controlling a flow of the liquid from the inverted supply bottle and delivering the liquid through the dispenser valve.

4. A walled dispenser base for use with a dispenser for delivering a liquid from an inverted supply bottle comprising:

a top portion whereon the inverted supply bottle is supported;

a rim;

a side opening formed in the walled dispenser base;

a foot formed at a bottom portion of the walled dispenser base; and a retaining device attached to the walled dispenser base, the retaining device having a threaded cylinder for storing a piercing tool for administering a vent hole in the inverted supply bottle, wherein a bottle cap removed from the inverted supply bottle is threadably secured to the threaded cylinder.

5. The walled dispenser base of claim 4 comprising a bottle collar engaging the top portion of the walled dispenser base, the bottle collar adapted to engage the inverted supply bottle positioned thereon, the bottle collar having a center aperture in a bottle seat where a mouth of the inverted supply bottle extends there through, the liquid from the inverted supply bottle being delivered from a dispenser valve coupled to the mouth of the inverted supply bottle.

6. The walled dispenser base of claim 4 comprising:

a bottle collar engaging the top portion of the walled dispenser base, the bottle collar adapted to engage the inverted supply bottle positioned thereon, the bottle collar having a center aperture in a bottle seat where a mouth of the inverted supply bottle extends there through; and a dispenser valve coupled to the mouth of the inverted supply bottle, the dispenser valve controlling a flow of the liquid from the inverted supply bottle and delivering the liquid through the dispenser valve.

7. A walled dispenser base for use with a dispenser for delivering a liquid from an inverted supply bottle, the inverted supply bottle coupled at a mouth thereof to a dispenser valve, the dispenser valve free of the walled dispenser base and extending though a side opening thereof, the walled dispenser base comprising:

a top portion whereon the inverted supply bottle is supported;

a rim having an open section;

a side opening formed in a side of the walled dispenser base, the side opening extending through the open section of the rim, the liquid from the inverted supply bottle being delivered through the side opening to a location outside of the walled dispenser base; and a foot formed at a bottom portion of the walled dispenser base and having a perimeter;

whereby the dispenser valve coupled to the inverted supply bottle may be lowered directly downward through the open section of the rim and into the side opening of the walled dispenser base, the dispenser valve extending through the side opening in the walled dispenser base beyond the perimeter of the foot.

8. A bottle collar for use with a dispenser base for delivering a liquid from an inverted supply bottle, the dispenser base having a rim with an open section and a side opening, the bottle collar comprising:

a top enclosure surrounding a portion of a sidewall of the inverted supply bottle and restricting a lateral movement of the supply bottle inverted and positioned therein;

a bottle seat formed to removably engage the inverted supply bottle, the bottle seat having a center aperture where a mouth of the inverted supply bottle extends there through when the inverted supply bottle is positioned thereon;

a peripheral portion formed to be removably engaged upon the dispenser base;

a bottom ring formed to restrict a lateral movement of the bottle collar upon the dispenser base; and a gap in a side of the bottle collar, the gap in the side of the bottle collar aligning with the open section of the rim to form a dispenser valve passage, the dispenser valve passage enabling a dispenser valve coupled to the mouth of the inverted supply bottle to be lowered directly downward into the side opening of the dispenser base.

9. A dispenser base for use with a dispenser for delivering a liquid from an inverted supply bottle comprising:

a top portion whereon the inverted supply bottle is supported;

a rim having an open section;

a side opening formed in a side of the dispenser base, the side opening extending through the open section of the rim;

a foot formed at a bottom portion of the dispenser base;

a bottle collar engaging the top portion of dispenser base, the bottle collar adapted to engage the inverted supply bottle positioned thereon, the bottle collar having a center aperture in a bottle seat where a mouth of the inverted supply bottle extends there through, the liquid from the inverted supply bottle being delivered from a dispenser valve coupled to the mouth of the inverted supply bottle and extending through the side opening; and a gap in a side of the bottle collar, the gap in the side of the bottle collar aligning with the open section of the rim to form a dispenser valve passage, the dispenser valve passage enabling the dispenser valve coupled to the mouth of the inverted supply bottle to be lowered directly downward into the side opening of the dispenser base.

10. A bottle collar for use with a dispenser base for delivering a liquid from an inverted supply bottle, comprising:

a top enclosure surrounding a portion of a sidewall of the inverted supply bottle and restricting a lateral movement of the supply bottle inverted and positioned therein;

a bottle seat formed to removably engage the inverted supply bottle, the bottle seat having a center aperture where a mouth of the inverted supply bottle extends there through when the inverted supply bottle is positioned thereon;

a peripheral portion formed to be removably engaged upon the dispenser base;

a bottom ring formed to restrict a lateral movement of the bottle collar upon the dispenser base; and a gap in a side of the bottle collar, the gap in the side of the bottle collar extending from a top of the bottle collar through a bottom of the bottle collar enabling a dispenser valve coupled to the mouth of the inverted supply bottle to be lowered directly downward into the bottle collar.

* * * * *